US006450777B2

(12) United States Patent
Lynn et al.

(10) Patent No.: US 6,450,777 B2
(45) Date of Patent: Sep. 17, 2002

(54) FLUID PUMPING APPARATUS

(75) Inventors: William H. Lynn, Kohler; Ross P. Christiansen, Kiel, both of WI (US)

(73) Assignee: Thomas Industries, Inc., Sheboygan, WI (US)

( * ) Notice: Subject to any disclaimer, the term of this patent is extended or adjusted under 35 U.S.C. 154(b) by 0 days.

(21) Appl. No.: 09/761,911

(22) Filed: Jan. 17, 2001

Related U.S. Application Data

(63) Continuation-in-part of application No. 09/593,639, filed on Jun. 13, 2000, which is a continuation of application No. 09/007,605, filed on Jan. 15, 1998, now Pat. No. 6,074,174, which is a continuation of application No. PCT/US96/12362, filed on Jul. 24, 1996, which is a continuation-in-part of application No. 08/506,491, filed on Jul. 25, 1995, now Pat. No. 5,593,291.

(51) Int. Cl.[7] ..... F04B 1/12
(52) U.S. Cl. ..... 417/269; 417/273; 417/539
(58) Field of Search ..... 417/269, 271, 417/419, 539; 91/500, 501; 92/171

(56) References Cited

U.S. PATENT DOCUMENTS

| | | | | |
|---|---|---|---|---|
| 862,867 A | | 8/1907 | Eggleston | 417/472 X |
| 3,961,868 A | | 6/1976 | Droege, Sr. et al. | 417/550 |
| 4,012,994 A | * | 3/1977 | Malmros | 91/499 |
| 4,028,015 A | | 6/1977 | Hetzel | 417/415 |
| 4,138,203 A | | 2/1979 | Slack | 417/269 |
| 4,396,357 A | | 8/1983 | Hartley | 417/269 |
| 4,507,058 A | | 3/1985 | Schoenmeyr | 417/271 X |
| 4,610,605 A | | 9/1986 | Hartley | 417/269 |
| 4,776,257 A | | 10/1988 | Hansen | 92/12.2 |
| 4,801,249 A | | 1/1989 | Kakizawa | 417/269 |
| 4,995,795 A | | 2/1991 | Hetzel et al. | 417/571 |
| 5,070,765 A | | 12/1991 | Parsons | 417/269 |
| 5,147,190 A | | 9/1992 | Hovarter | 417/571 |
| 5,362,208 A | | 11/1994 | Inagaki et al. | 417/269 |
| 5,419,685 A | * | 5/1995 | Fujii et al. | 417/269 |
| 5,593,291 A | | 1/1997 | Lynn | 417/539 |

FOREIGN PATENT DOCUMENTS

DE 4411383 A1 11/1994

* cited by examiner

*Primary Examiner*—Willis R. Wolfe
*Assistant Examiner*—Mahmoud Gimie
(74) *Attorney, Agent, or Firm*—Quarles & Brady LLP

(57) ABSTRACT

An axial piston fluid pumping apparatus is disclosed in which wobble pistons are rigidly connected to arms of a nutating plate that is rotatably mounted on a bearing which is mounted on a drive shaft. The axis of the bearing is at an acute angle to the axis of the shaft. The wobble pistons move within cylinders whose bores are disposed about the axis of the shaft. In one embodiment, the pistons are supported by leaf springs and radially resilient connecting rods and the crankcase is enclosed.

28 Claims, 21 Drawing Sheets

FIG. 1
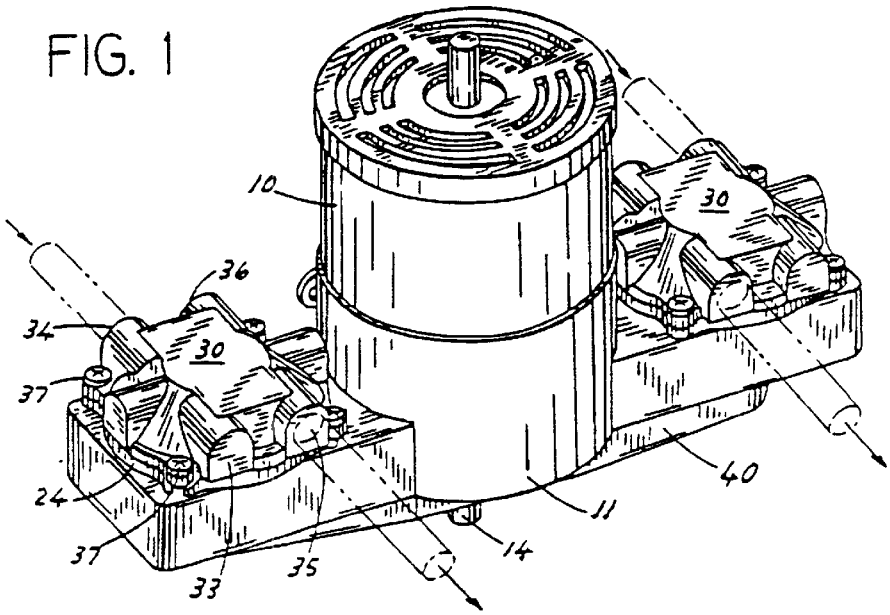
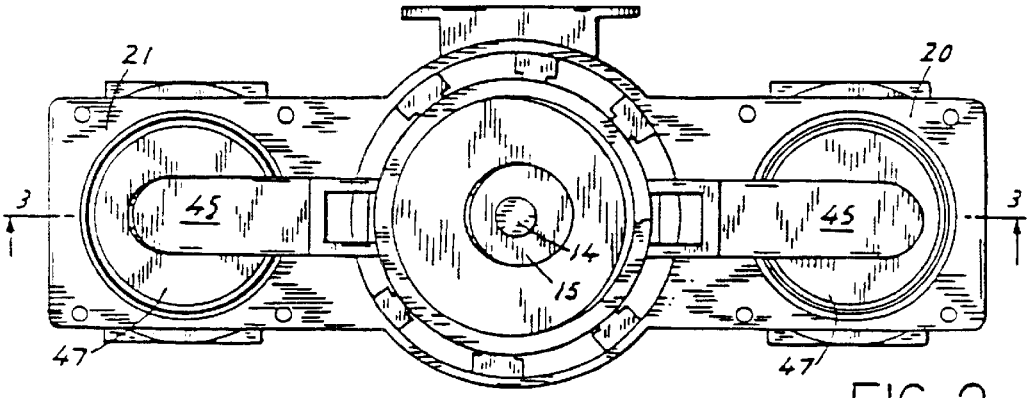
FIG. 2
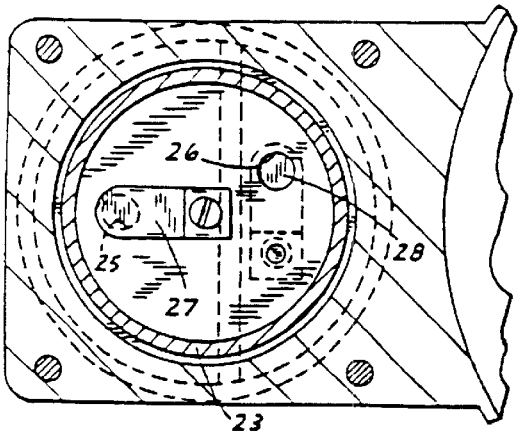
FIG. 5

FIG. 4
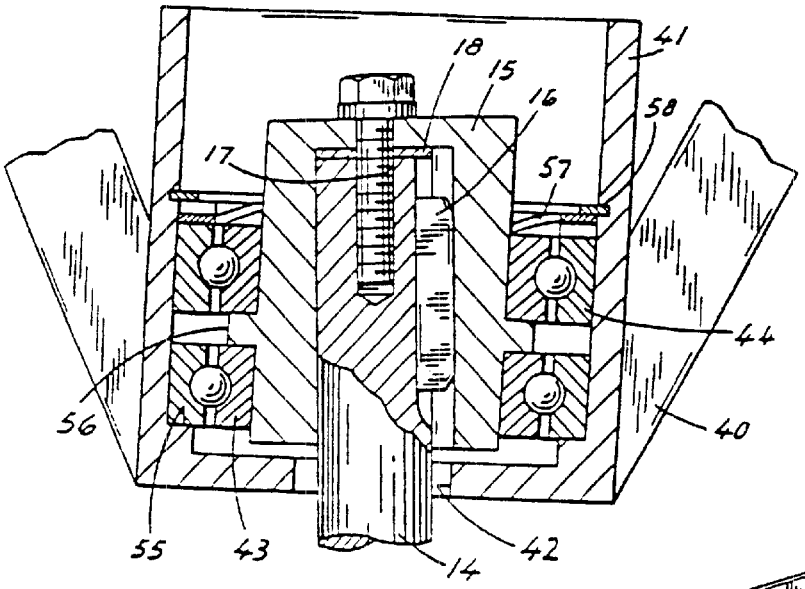
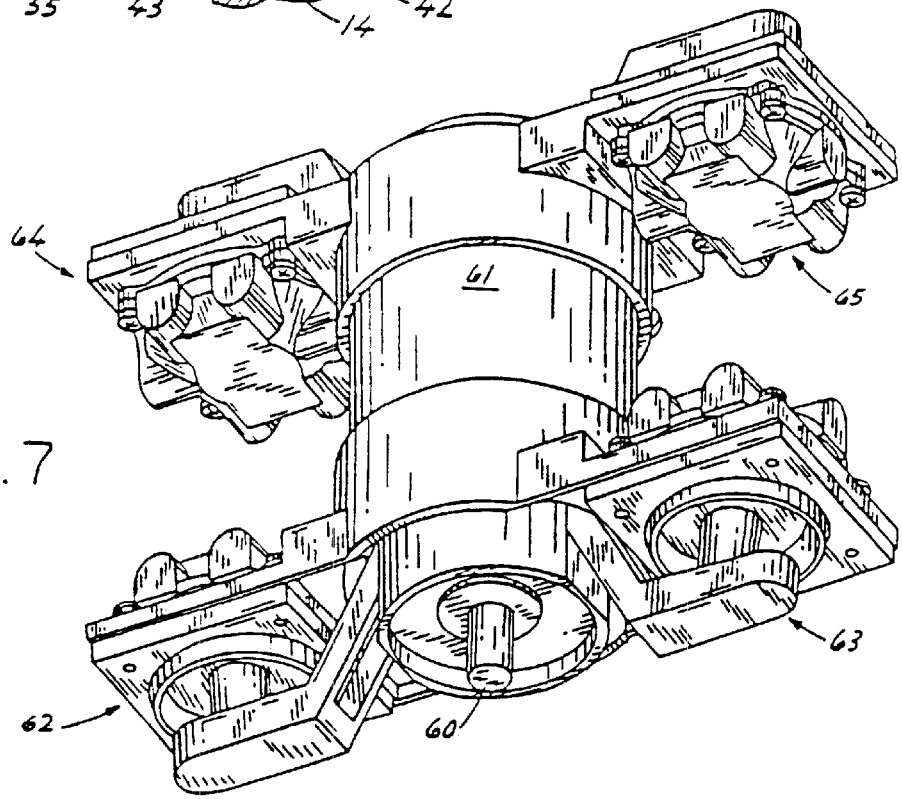
FIG. 7

FLUID PUMPING APPARATUS

BACKGROUND OF THE INVENTION

This application is a continuation-in-part of U.S. application Ser. No. 09/593,639 filed Jun. 13, 2000, which is a continuation of U.S. application Ser. No. 09/007,605 filed Jan. 15, 1998 which issued on Jun. 13, 2000 as U.S. Pat. No. 6,074,174, which is a continuation of International Application No. PCT/US96/12362 filed Jul. 24, 1996, which is a continuation-in-part of U.S. application Ser. No. 08/506,491 filed Jul. 25, 1995, now U.S. Pat. No. 5,593,291.

Two known types of compressors are the wobble piston type and the swashplate type. The wobble piston type is exemplified by U.S. Pat. No. 3,961,868 issued Jun. 8, 1976, to Droege, Sr., et al. for "Air Compressor". Such a compressor uses a piston whose head has a peripheral seal that seals with a cylinder bore. The piston rod is mounted radially on a crankshaft. The piston includes no joints or swivels. As a result, the piston head is forced to "wobble" in two dimensions within the cylinder bore as it is driven by the crankshaft.

The swashplate type compressor uses a plurality of axial cylinders arranged in a circle about a drive shaft. A swashplate is inclined relative to the shaft axis such that the plate gyrates as the drive shaft is rotated. Pistons are mounted in each of the cylinders. The ends of the piston rods are connected to elements that slide over the surface of the swashplate as the swashplate rotates. The result is that the centerline of the piston head is moved solely in an axial direction as the pistons are stroked within the cylinders. An example of such an axial piston swashplate compressor is found in U.S. Pat. No. 5,362,208 issued Nov. 8, 1994 to Inagaki, et al. for "Swashplate Type Compressor". Another example is U.S. Pat. No. 4,776,257 issued Oct. 11, 1988, to Hansen for "Axial Pump Engine". In the Hansen patent, the centerline of the piston heads are inclined relative to the centerline of the cylinder bore, but the piston heads are moved only along the piston head centerline in one direction.

The present invention combines the wobble pistons normally used in radial piston pumps with a nutating plate rather than the swashplate normally used in axial piston pumps. The result is a simple and effective fluid pumping apparatus.

SUMMARY OF THE INVENTION

In accordance with the invention, a fluid pumping apparatus includes a drive shaft and a cylinder having a bore. Fluid inlet and outlet valves communicate with the cylinder bore. A bearing is mounted on the shaft with the centerline of the bearing at an angle to the shaft axis. A piston carrier is mounted on the bearing. A wobble piston is rigidly attached to the arm and is disposed in the cylinder bore. As the drive shaft rotates, the centerline of the bearing will precess about the shaft axis, and the arm will be moved, thereby causing the wobble piston to move in three dimensions within the cylinder bore.

In one aspect of the invention, the piston is supported by a leaf spring, which helps control the movement of the piston and reduce the bearing loads. Multiple pistons and leaf springs are preferably provided, and the leaf springs are prevented from rotating in a plane perpendicular to the shaft axis.

In another aspect, the pistons are connected to the piston carrier by radially resilient but axially stiff connecting rods.

The axial stiffness of the connecting rods is sufficient to exert the required forces of compression and vacuum on the piston without significant change in length of the rod, but is radially resilient so as to reduce the radial loads exerted on the piston seal, and therefore increase the life of the piston seal.

In another aspect, particularly where multiple pistons are employed operating in phased relationship with one another, the piston carrier, leaf springs and open ends of the cylinders are enclosed to reduce noise. A filter opening may be provided in the enclosure, which is necessary if intake is through the pistons as is preferred. The enclosure preferably does not enclose the outside surfaces of the cylinders, so as to permit cooling air to circulate around them.

In another preferred aspect, one end of the cylinders are seated against a housing and the housing supports bearings which support the shaft so as to cantilever the rotor of the motor inside the stator, with the stator mounted to the side of the housing opposite from the crankcase of the pump. A cylinder retainer is seated against the opposite ends of the cylinders and is fixed to the housing to clamp the cylinder, to the housing. The cylinder retainer preferably includes a tapered lead-in surface into the open ends of the cylinders. The cylinder retainer also defines cavities around the leaf springs, and a cover mates with the cylinder retainer to enclose the crankcase to reduce noise. Multiple cylinders are arranged in phased relationship with one another so that the volume of the crankcase stays substantially constant as the pistons reciprocate in the cylinders.

In another aspect of the invention, the inlet valves are provided in the pistons and the outlet valves are provided in the housing. A head over the outlet valves defines an exhaust chamber common to all of the cylinders and provides an outlet port.

In another preferred aspect, the "top" surface of each cylinder is in the shape of a section of a cone, so as to minimize the clearance volume of the cylinder as the piston moves through its top dead center position.

It is a principal object of the invention to provide a simplified axial piston pumping apparatus using wobble pistons.

It is another object of the invention to provide an axial piston pump of quiet operation, efficient power usage and good longevity which does not require the use of sliding elements requiring continuous lubrication.

The foregoing and other objects and advantages of the invention will be apparent from the following detailed description. In the description, reference is made to the drawings which illustrate preferred embodiments of the invention.

BRIEF DESCRIPTION OF THE DRAWINGS

FIG. 1 is a view in perspective of a first embodiment of the invention utilizing a pair of cylinders and wobble pistons;

FIG. 2 is an end view of the apparatus of FIG. 1;

FIG. 4 is an enlarged view in section showing the preferred hub and bearings assembly;

FIG. 5 is a plan view of a valve plate taken in the plane of the line 5—5 of FIG. 3;

FIG. 7 is a view in perspective of a second embodiment of the invention utilizing two pairs of cylinders and wobble pistons;

DETAILED DESCRIPTION OF THE PREFERRED EMBODIMENTS

Figure 3:
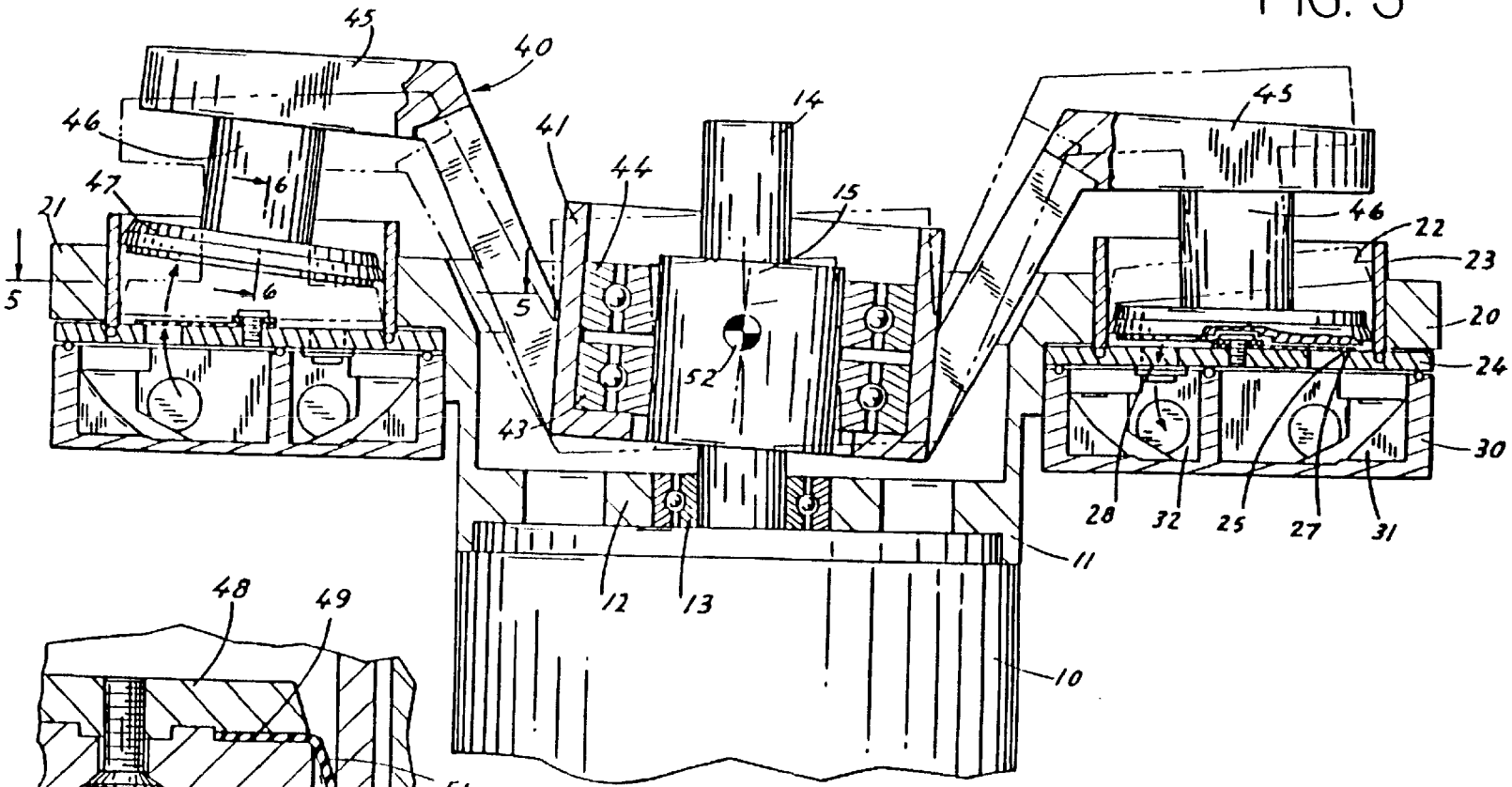
FIG. 3 is a view in section taken in the plane of the line 3—3 of FIG. 2.
Figure 6:
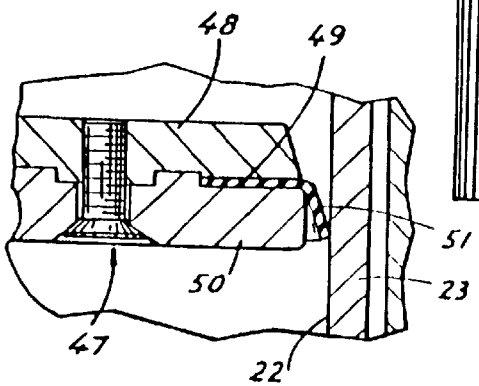
FIG. 6 is an enlarged view in section through a piston head and taken in the plane of the line 6—6 of FIG. 3.

Although the invention can be adapted for pumping a wide variety of fluids, it is particularly useful in an air compressor or vacuum pump. Referring to FIGS. 1 through 6, an electric motor 10 is rabbeted to a housing 11. The housing includes a support plate 12 which mounts a bearing 13 for a motor drive shaft 14. A hub 15 is connected to the shaft 14 by means of a key 16, as shown in FIG. 4. The hub 15 is locked axially on the drive shaft 14 by means of a bolt 17 that is threaded into an axial bore in the end of the drive shaft 14. A shim washer 18 is disposed between the head of the bolt 17 and the hub 15 to allow for adjustment of the axial clearance between the shaft 14 and hub 15. As is apparent from FIGS. 3 and 4, the centerline or axis of the hub 15 is at an acute angle to the axis of the shaft 14.

The housing 11 mounts a pair of axial cylinders 20 and 21 having cylinder bores 22 each defined by a cylinder sleeve 23. The centerlines of the cylinder bores 22 are parallel to the axis of the drive shaft 14. A valve plate 24 closes off the top of each cylinder 20 and 21. Each Valve plate 24 includes an inlet valve opening 25 and an outlet valve opening 26. The valve openings 25 and 26 are normally closed by an inlet flapper 27 and an exhaust flapper valve 28, respectively. A cylinder head 30 is mounted on each valve plate 24. The cylinder heads 30 each include an inlet chamber 31 and an exhaust chamber 32. The heads 30 have inlet or outlet connection points 33 and 34 leading to the inlet chamber 31 and similar connection points 35 and 36 leading to the exhaust chamber 32. As will be explained further hereafter, the inlet and exhaust chambers 31 and 32 can be connected in a variety of ways through the connection points 33 through 36 to external piping.

The heads 30 and valve plates 24 are joined to the cylinders 20 and 21 by bolts 37. Suitable O-rings seal the mating surfaces of the head 30 with the valve plate 24 and of the cylinder sleeve 22 with the valve plate 24. The construction of the valve plates 24, heads 30, and cylinder sleeves 22 is similar to that which is illustrated and described in U.S. Pat. No. 4,995,795 issued Feb. 26, 1991, to Hetzel, et al., and assigned to the assignee of this application. The disclosure of the Hetzel, et al. '795 patent is hereby incorporated by reference as though fully set forth herein.

A nutating plate 40 has a central cup 41 with an enlarged rear opening 42 that receives the drive shaft 14. A pair of deep-grooved ball bearings 43 and 44 have their inner races mounted about the hub 15 and their outer races mounted within the cup portion 41 of the plate 40. The plate 40 has a pair of arms 45 extending laterally in opposite directions from the cup portion 41. Each of the arms 45 rigidly mounts a wobble piston 46 having its piston head 47 disposed in the bore of one of the cylinders 20 and 21. The piston heads 47 are of known construction. Briefly, they include a main piston portion 48 which mounts a seal 49 that is clamped to the main portion 48 by a clamp plate 50. The seal 49 has a peripheral flange 51 which seals with the cylinder bore 22. The seal 49 is preferably made of Teflon or other similar material that does not require lubrication. The details of the construction of the piston head are shown in U.S. Pat. No. 5,006,047 issued Apr. 9, 1991, to O'Connell and assigned to the assignee of this invention. The disclosure of the O'Connell '047 patent is hereby incorporated by reference as though fully set forth herein.

As the drive shaft 14 is rotated by the motor 10, the centerline or axis of the hub 15 will precess in a conical path about the axis of the shaft 14. The movement of the hub 15 is translated into three dimensional movement of the piston heads 47 within the cylinder bores 22. The ends of the arms 45 will move through one arc in the plane of the section of FIG. 3. The ends of the arms 45 will also move through a much smaller arc in a plane that is normal to the plane of the section of FIG. 3.

For best operation, the center of gravity 52 of the assembly of the plate 40 and the wobble pistons 46 is located at or near the intersection of the axes of the hub 15 and the drive shaft 14. This will ensure the smoothest, quietest operation with the least vibration, The preferred assembly of the hub 15, bearings 43 and 44, and cup 41 is shown in FIG. 4. The outer race of one of the bearings 43 is disposed against a ledge 55 in the cup 41. The inner races of the bearings 43 and 44 are disposed against a flange 56 extending from the hub 15. Finally, the outer race of the second bearing 44 abuts a wavy washer 57 held in place by a snap ring 58.

The fluid pumping apparatus does not involve sliding surfaces that must be lubricated, as is typical in axial piston swashplate type compressors. The only sliding action is that of the seal 49 of the wobble pistons on the cylinder bores 22. The seals 49 have proven to be capable of such motion without the need for lubrication.

The apparatus can be used either as a compressor or a vacuum pump depending upon what devices are connected to the inlet and exhaust chambers. The apparatus of FIGS. 1–6 is arranged to operate as a compressor. To function as a vacuum pump, it is preferable to mount the seals 49 in a manner such that their peripheral flanges 51 extend away from the bottom of the cylinder. This is the reverse of that shown in FIGS. 1–6.

Although the first embodiment uses a pair of symmetrically arranged cylinders, any number of cylinders with corresponding numbers of wobble pistons may also be used. The cylinders should be arranged symmetrically about the shaft axis. Furthermore, the invention is also useful with only a single cylinder with a single arm mounting a wobble piston disposed in the single cylinder.

In the embodiment of FIG. 7, a pair of cylinders with wobble pistons are mounted on each end of a through-shaft 60 of a motor 61. In the arrangement of FIG. 7, the assembly of hubs, bearings, cylinders, valve plates, heads, and nutating plates, as described with respect to FIGS. 1 through 6, is duplicated on each end of the through-shaft 60 of the motor 61. The cylinder assemblies 62 and 63 on one end of the through-shaft 60 are aligned with the cylinder assemblies 64 and 65 on the other end of the through-shaft 60. To best balance the dynamic forces, the pistons operating in each pair of aligned cylinders 62, 64, and 63, 65 move in opposite directions to each other.

The fluid pumping apparatus of this invention may be used as a compressor or a vacuum pump. It may be plumbed in a variety of manners. For example, the embodiment of FIGS. 1–6 may have each of the cylinders separately plumbed so that each acts as an independent pumping device, either as a compressor or a vacuum pump. As an alternative, the exhaust chamber 32 of one of the two cylinders may be connected to the inlet chamber 31 of the other of the two cylinders so that a two-stage pressure or vacuum operation is achieved.

Figure 8A:
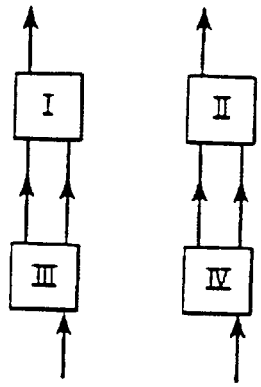
FIGS. 8*a* through 8*d* are schematic representations of alternative arrangements for connecting the cylinders in the embodiment of FIG. 7.
Figure 8B:
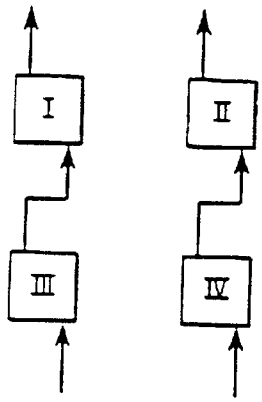

The four-cylinder arrangement of the embodiment of FIG. 7 affords even greater alternatives for interconnection. Some of the possible alternatives are illustrated in FIGS. 8*a* through 8*d* in which the four cylinders are identified by I through IV. In FIG. 8*a*, a compressor or pump arrangement is shown in which the inlet chambers of cylinders III and I are connected in parallel, and the outlet chambers of cylinders III and I are similarly connected in parallel. The result is that cylinders I and III function as two separate compressors or two separate pumps. The cylinders IV and II may be similarly plumbed in parallel so that they can function as two separate compressors or two separate pumps. In the arrangement of FIG. 8*a*, the cylinders I and III can function as compressors while the cylinders II and IV can function as pumps, or vice versa. In the arrangement illustrated in FIG. 8*b*, the pair of cylinders I and III are connected in series. That is, the exhaust chamber of cylinder III is connected to the inlet chamber of cylinder 1. The result is that there is a two-stage compression or pumping. In FIG. 8*b*, the cylinders II and IV are similarly connected in series, but they could also be connected in parallel as in FIG. 8*a*.

Figure 8C:
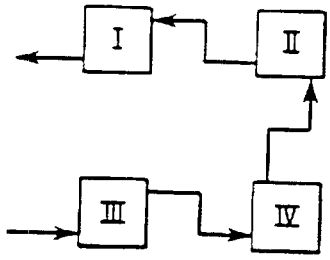
Figure 8D:
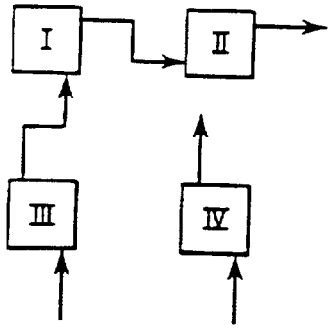

FIG. 8*c* illustrates an arrangement in which all four of the cylinders I through IV are connected in series so that there is a four-stage pumping or compression action. In FIG. 8*d*, three of the cylinder heads I, II, and III are connected in series while the fourth operates separately. Persons of ordinary skill in the art will appreciate many additional arrangements of plumbing that could be used.

Figure 9:
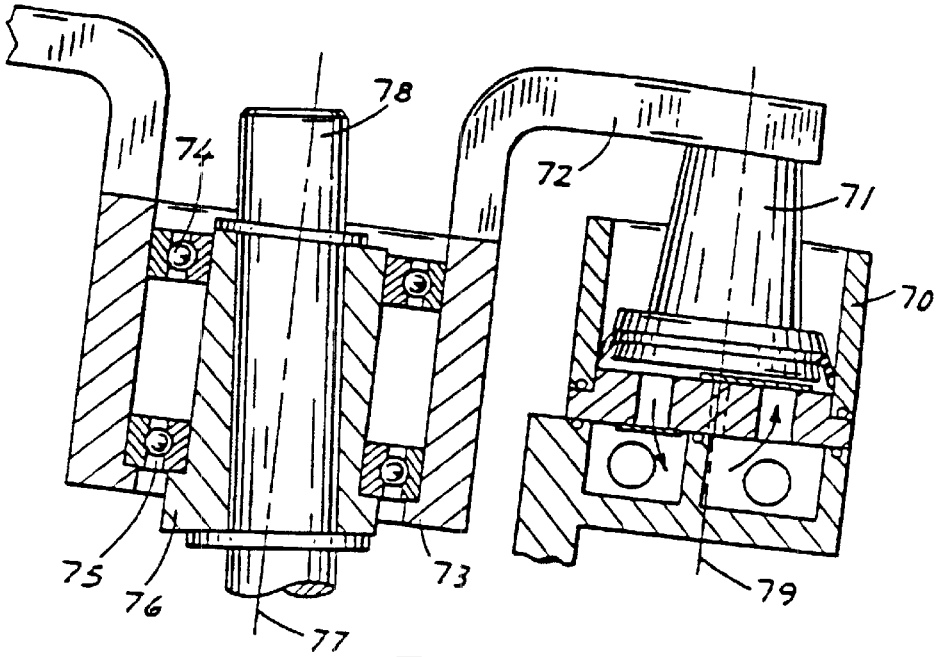
FIG. 9 is a partial view in section similar to FIG. 3 but showing an alternative embodiment in which the centerlines of the cylinder bores are parallel to the centerline of the bearing.
Figure 10:
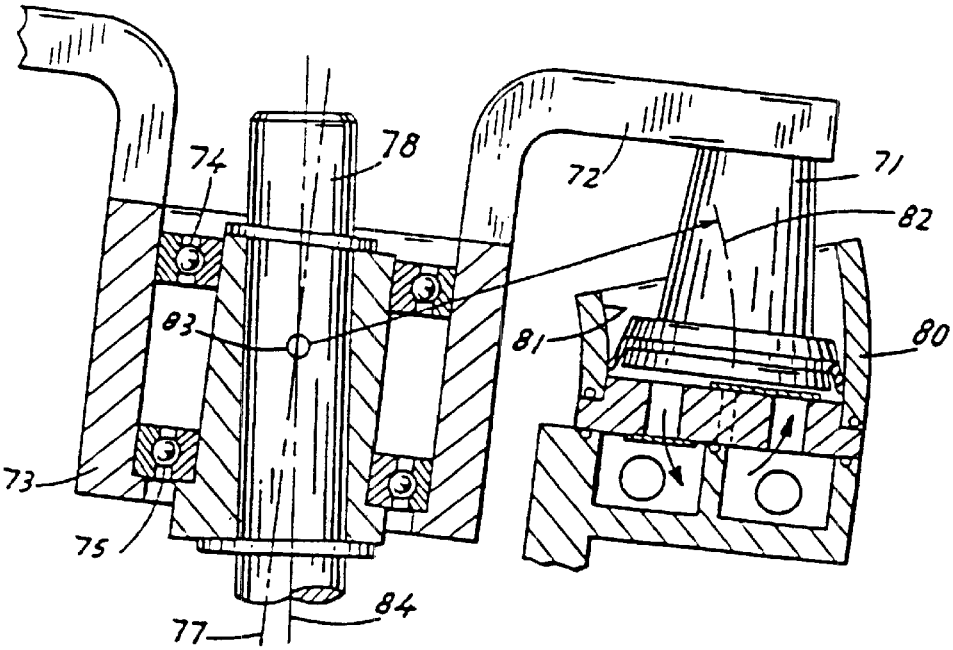
FIG. 10 is a partial view in section similar to FIG. 3 but showing an alternative embodiment in which the centerlines of the cylinder bores are formed as an arc of a circle whose center is at the intersection of the shaft axis and the bearing centerline.

In the embodiments described thus fart, the centerlines of the cylinder bores are parallel to the axis of the motor shaft. FIGS. 9 and 10 show two alternatives to that arrangement. In FIG. 9, a cylinder 70 receives a wobble piston 71 rigidly attached to an arm 72 extending from a nutating plate 73. The plate 73 is mounted on bearings 74 and 75 disposed about a hub 76. As in the previous embodiments, the hub 76 has its centerline 77 disposed at an acute angle to the axis of a shaft 78. In the embodiment of FIG. 9, the centerline 79 of the bore of the cylinder 70 is parallel to the centerline 77 of the hub 76. The plate 73 could mount several arms 72 with wobble pistons 71 disposed in several cylinders 70.

In FIG. 10, a cylinder 80 is formed with a cylinder bore 81 the centerline 82 of which is disposed along an arc of a circle whose center 83 is at the intersection of the hub axis 77 and the shaft axis 84.

Figure 11:
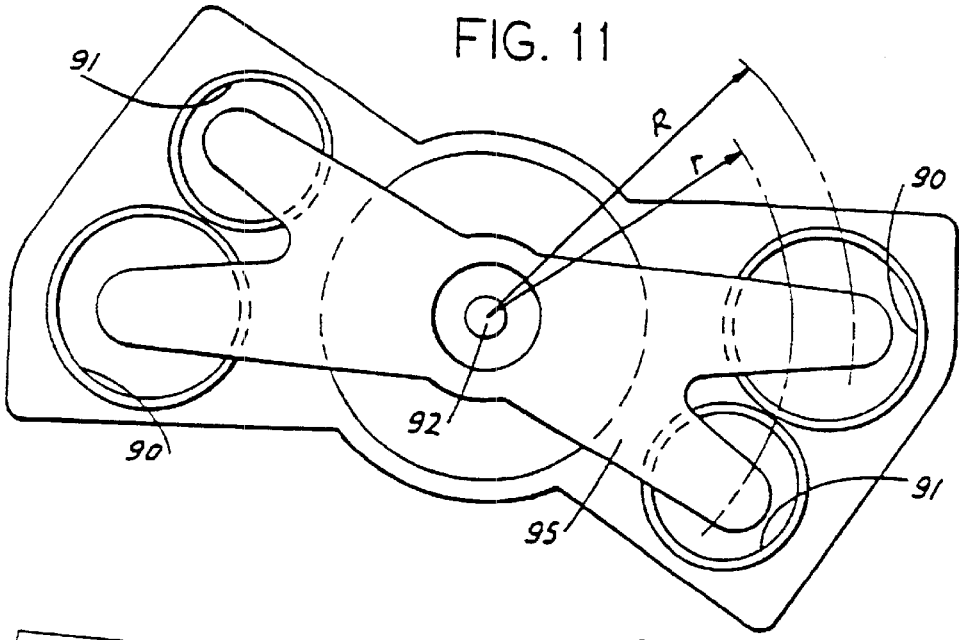
FIG. 11 is a plan view of another embodiment in which cylinder bores of difference diameters are arranged at different distances from the shaft axis.
Figure 12:
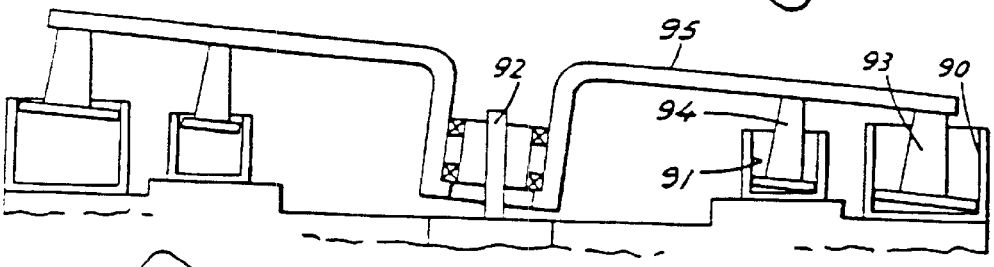
FIG. 12 is a schematic side view, partially in section, of the embodiment of FIG. 11.

In the embodiments described thus far, the cylinder bores have been of identical size and have been located at the same distance from the motor shaft. FIGS. 11 and 12 illustrate an arrangement in which the cylinder bores are of different diameters and are arranged at different distances from the motor Shaft. Specifically, two sets of cylinder bores 90 and 91 are arranged symmetrically with respect to the motor shaft 92. The cylinder bores 90 of the first set are larger in diameter than the bores 91 of the second set. Correspondingly larger wobble pistons 93 operate in the larger bores 90 with smaller wobble pistons 94 operating in the smaller bores 91. The larger wobble pistons 93 are mounted on arms of a plate 95 at a distance R from the axis of the shaft 92. The smaller wobble pistons 94 are mounted on the plate 95 at a smaller distance r from the axis of the shaft 92. As a result of the arrangement of FIG. 1, the stroke of the larger pistons 93 will be longer than that of the smaller pistons 94 due to the shorter distance from the motor shaft 92.

Figure 13:
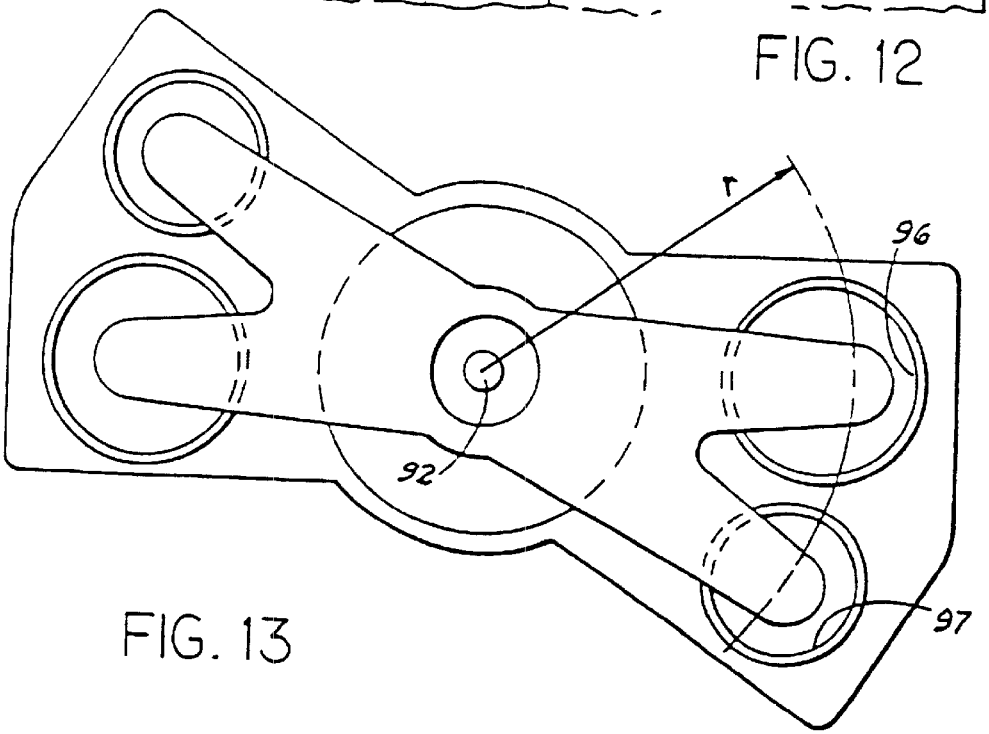
FIG. 13 is a plan view of a further embodiment in which cylinder bores of different diameters are arranged at the same distance from the shaft axis.

FIG. 13 illustrates a further embodiment in which two sets of cylinder bores 96 and 97 are of different sizes but are arranged at the same radial distance r from the centerline of the shaft 92.

By selecting the combinations of bore size and piston stroke, the same or different pressures can be achieved in each of the cylinders. Larger bores with a shorter piston stroke can achieve low pressure but high flow. At the same time, smaller bores with a longer piston stroke can achieve high pressure operation but at a lower flow. The cylinders can be staged by having the exhaust of a high flow, lower pressure cylinder plumbed to the inlet of a higher pressure cylinder.

Figure 14:
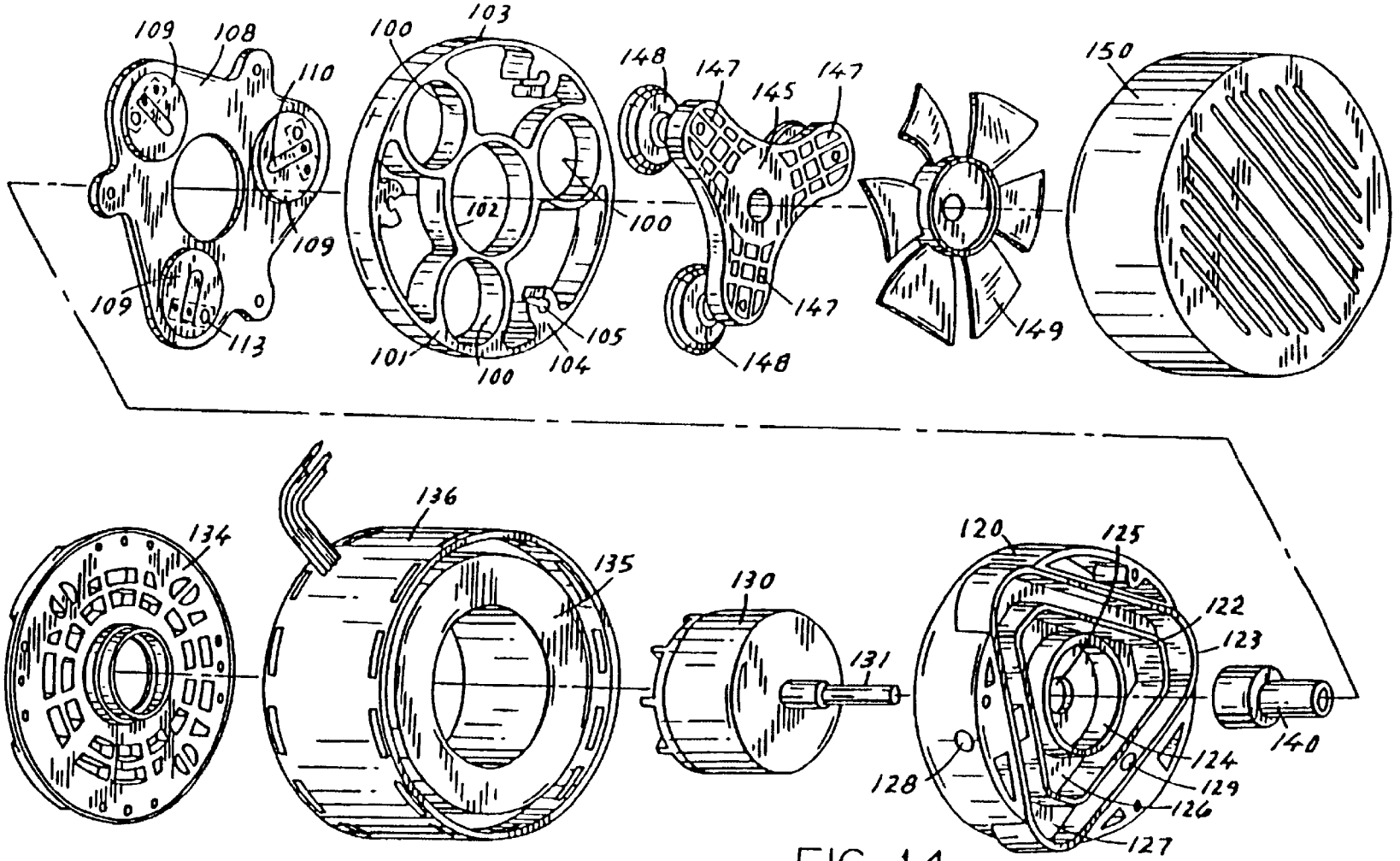
FIG. 14 is an exploded perspective view of yet another embodiment providing a compact, stacked arrangement of elements.
Figure 15:
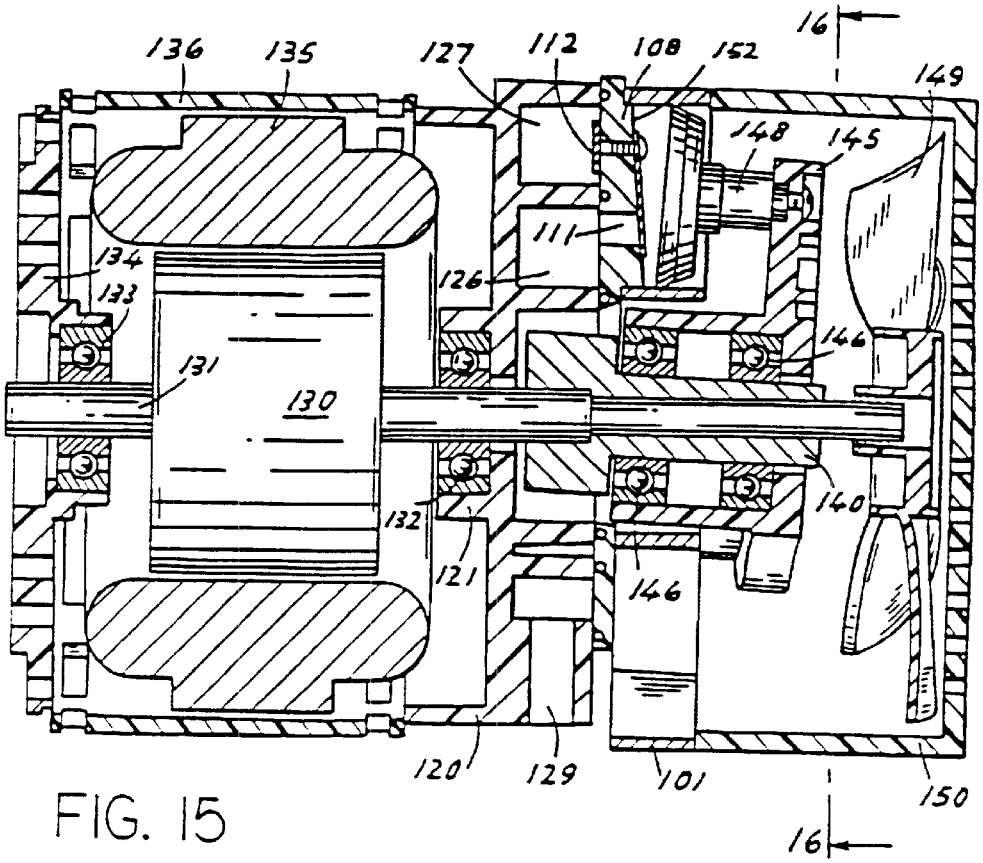
FIG. 15 is a view in longitudinal section of the embodiment of FIG. 14.
Figure 16:
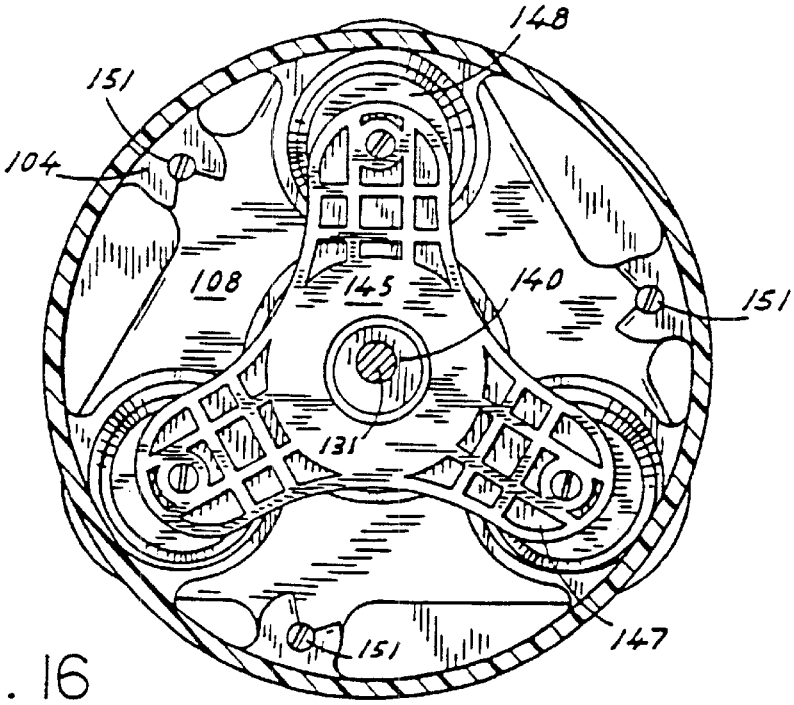
FIG. 16 is a view in elevation, and partially in section, taken in the plane of the line 16—16 of FIG. 15.

The embodiment of FIGS. 14 through 16 is a compact, stacked arrangement with three cylinders arranged symmetrically about a motor shaft axis. The cylinder bores 100 are formed in a extruded aluminum cylinder sleeve 101 which also includes a large central opening 102. The cylinder sleeve 101 has an outer continuous shell 103 from which bosses 104 extend inwardly and include bolt openings 105.

A single valve plate 108, also preferably formed of aluminum, includes three identical valve supports 109 which are received in the three cylinder bores 100. Each valve support 109 mounts an inlet flapper valve 110 that normally closes an inlet opening 111 and exhaust flapper valve 112 that normally closes an exhaust opening 113.

A cast aluminum head 120 has a bearing well 121 on its backside and projecting inner and outer walls 122 and 123, respectively, on its front side. A central circular flange 124 also projects from the front face about a central opening 125. The space between the central flange 124 and the inner wall 122 defines an inlet chamber 126 while the space between the inner and outer walls 122 and 123 defines an exhaust chamber 127. A passageway 128 leads from the exterior of the head 120 to the inlet chamber 126 and another passageway 129 leads from the exterior of the head 120 to the exhaust chamber 127.

The cylinder sleeve 101 valve plate 108 and head 120 are adapted to be stacked together. When stacked, the inlet ports 111 for all three cylinder bores 100 will be in communication with the inlet chamber 126 in the head 120. Similarly, the exhaust ports 113 for all three cylinder bores 100 will be in communication with the exhaust chamber 127 of the head 120. O-ring seals along the edges of the central flange 124 and the inner and outer walls 122 and 123 seal with the flat surfaces of the valve plate 108. Also, O-ring seals surrounding the valve supports 109 seal with the edges of the cylindrical bores 100, as shown in FIG. 15.

A rotor 130 of an electric motor is mounted on a motor shaft 131 which is journaled in a roller bearing 132, held in the bearing well 121 of the head 120, and in a second roller bearing 133 mounted in an end cap 134. A motor stator 135 is disposed about the rotor 130 and a sleeve 136 surrounds the stator. The motor shaft 131 projects through the central openings in the head 120, the valve plate 108 and the cylinder sleeve 101. A hub 140 is mounted on the end of the projecting end of the shaft 131. As with the other embodiments, the hub 140 has its centerline at an acute angle to the axis of the shaft 131. A piston carrier 145 is supported by bearings 146 on the outside of the hub 140. The piston carrier 145 has three symmetrical arms 147 to which are bolted the ends of wobble pistons 148 which are received in the cylinder bores 100.

The motor shaft 131 projects beyond the hub 140 to mount a fan 149. A fan enclosure 150 completes the assembly. The assembly of the end cap 134, sleeve 136, head 120, valve plate 108, and cylinder sleeve 101, is held in place by through bolts 151. The bolts 151 are preferably threaded into threaded openings in the end cap 134. The fan housing 150 may be held in place by radial screws (not shown).

As shown in FIG. 15, the face 152 of each valve support 109 which confronts the head of a wobble piston 148 is inclined so that it is virtually parallel with head of the piston 148 when the piston is at top dead center. This minimizes the clearance volume and results in higher pressures and greater efficiency.

In the embodiment of FIGS. 14–16, the valve plate 108 and cylinder sleeve 102 may be formed as a single member by casting or injection molding. Similarly, the sleeve 136 may be formed integral with the head member 120. Although cast or extruded aluminum is preferred for the cylinder sleeve 101, valve plate 108, and head member 120, other materials may also be used, including filled plastics, steel, and cast iron.

Figure 17:
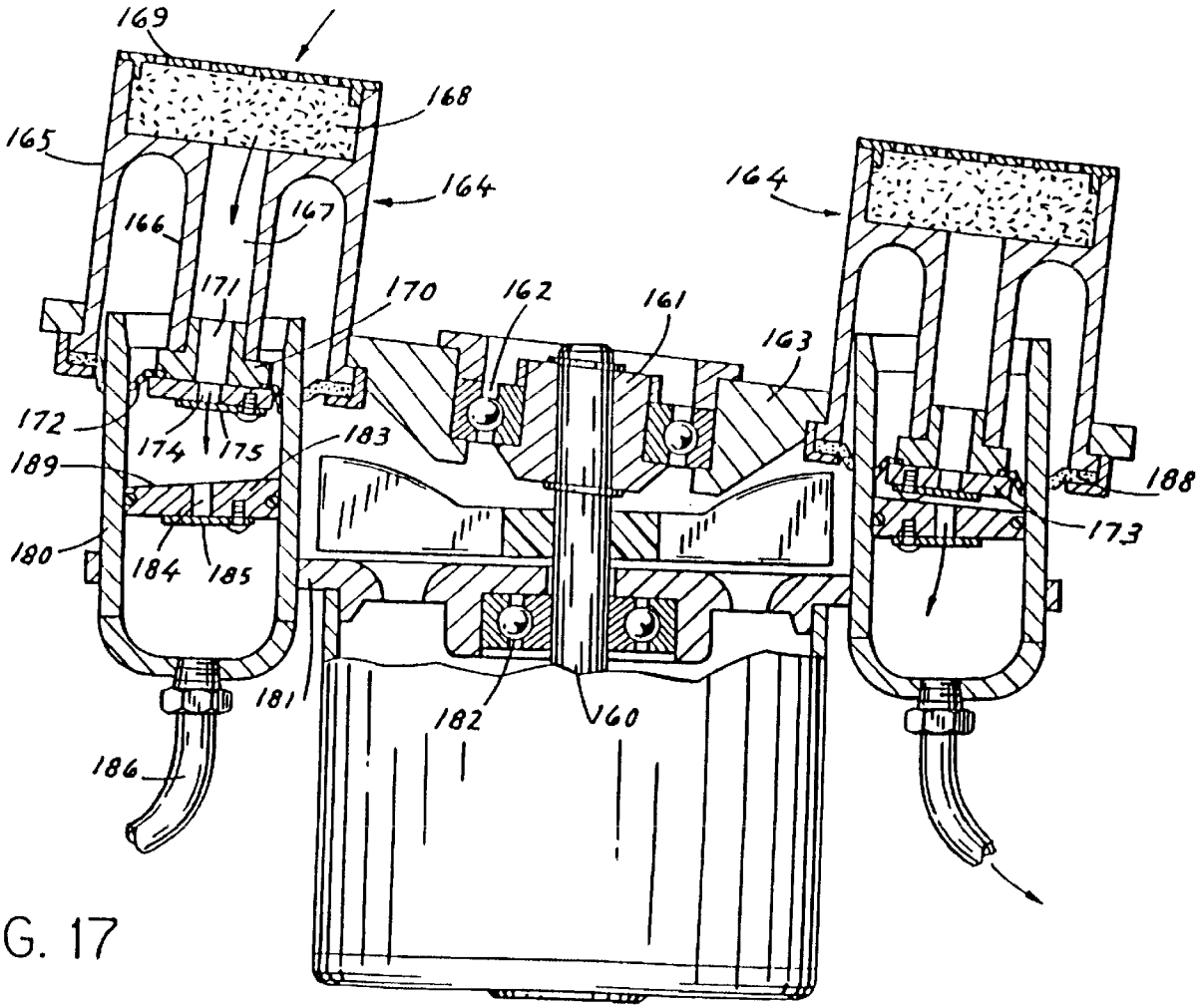
FIG. 17 is a view in section similar to FIG. 3 but showing an embodiment in which the inlet valves are located in the wobble pistons.
Figure 18:
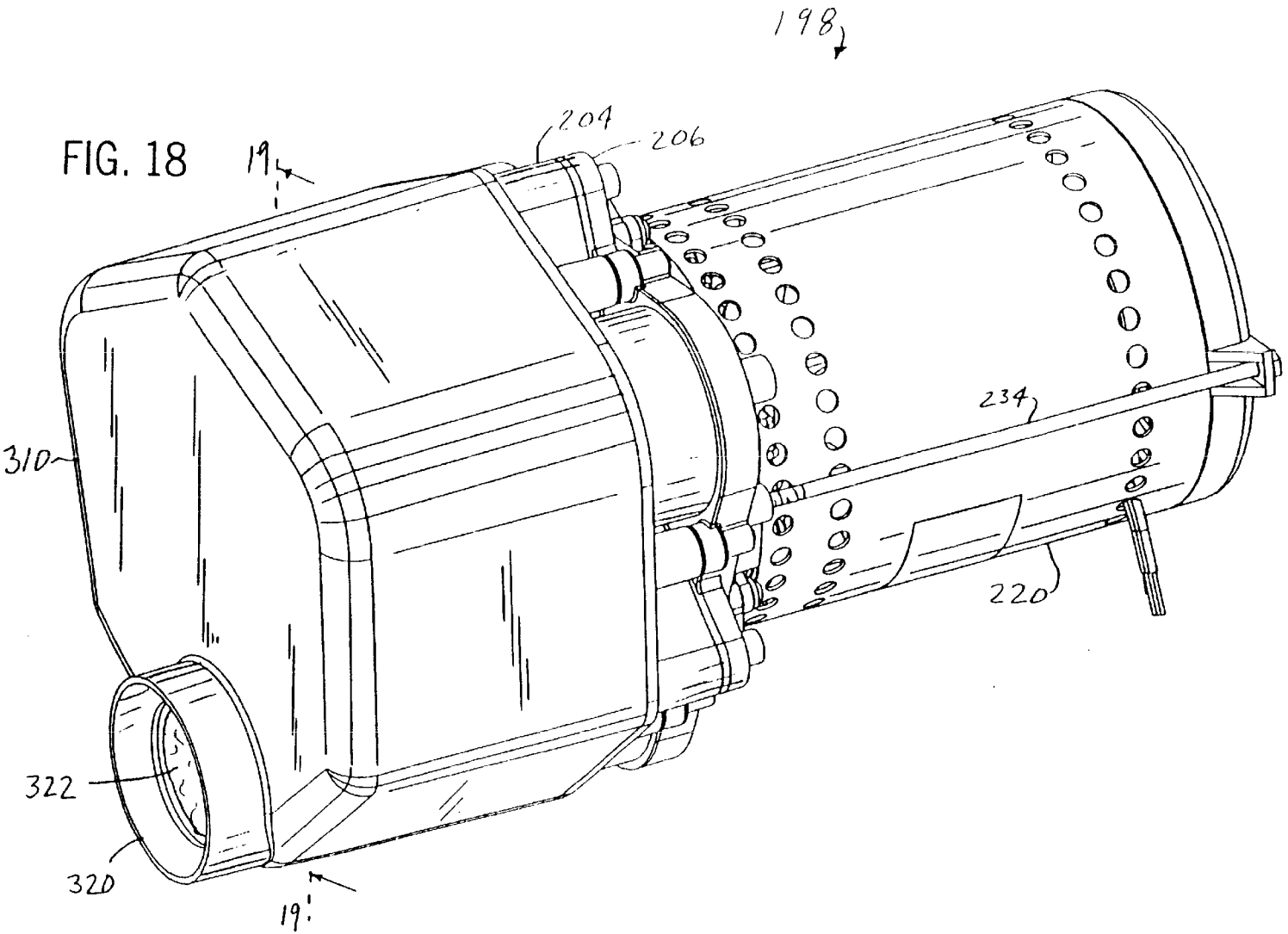
FIG. 18 is a perspective view of an embodiment having leaf springs supporting the piston carrier and an enclosed crankcase.

In the embodiment of FIG. 17, the inlet valves are formed in the wobble pistons and provision is made to filter incoming air and to seal the apparatus for dirt exclusion and low noise. As in the previous embodiments, a motor shaft 160 mounts a hub 161 whose centerline is at an acute angle to the axis of the shaft 160. The hub 161 mounts a ball bearing 162 which in turn supports a carrier 163. The carrier 163 mounts piston assemblies indicated generally by the reference number 164. The assemblies 164 include an outer cylindrical housing 165, and an integral central piston rod 166 having a central longitudinal passage 167. The end of the passage 167 is protected by filter media 168 and a grill 169 mounted on the outer cylindrical portion 165. A wobble piston bead 170 is mounted on the end of the rod portion 166 and includes a central opening 171. A cup type seal 172 is gripped between the piston head 170 and a retainer 173. The retainer 173 has an inlet port 174 which communicates with the opening 171 and passage 167. A flapper valve 175 normally closes the inlet port 174.

Each piston operates in a cylinder 180 supported on a plate 181, which includes a shaft bearing 182. An exhaust valve plate 183 seals with the bore of the cylinder 180. The valve plate 183 includes an exhaust port 184 normally closed by a flapper valve 185. The portion of the cylinder 180 beneath the valve plate 183 comprises an exhaust chamber to which a exhaust tube 186 is connected. The outer cylindrical portion 165 of each piston assembly 164 mounts a radial seal 188 which seals with the exterior of the cylinder 180 as the piston assembly 164 moves in and out of the cylinder 180. The seal 188 may be formed of felt or other material that prevents dirt or other particulates from entering into the interface between the piston and the cylinder.

The face 189 of each valve plate 183 which confronts the piston retainer 173 is inclined to be closely parallel to the surface of the retainer 173 when the piston is at top dead center.

The embodiment 198 of FIGS. 18–23 is another compact, stacked arrangement with three cylinders arranged symmetrically about a motor shaft axis. The cylinder bores 200 are formed by separate cylinders 202 which are sandwiched between a cylinder retainer 204 and a housing 206. The retainer 204 is bolted to the housing 206 with bolts 208. Bearings 210 and 212 are mounted in a central opening in the housing 206 and motor shaft 214 are journal led by the bearings to cantilever rotor 216 inside stator 218 which is mounted in motor shell 220. Shaft 214 extends beyond the opposite end of the rotor 216 and mounts at that end fan 222, which draws air through cooling air intake grill 226 into the motor to cool the motor and to cool the head 230, which is bolted to the motor side of the housing 206 by bolts 232. Long bolts 234 secure the motor to the housing 206, and the housing shell 220 may also be pressed onto a flange 238 of the housing 206.

Shaft 214 also mounts a two piece fan 240, including outer fin piece 242 and inner fin piece 244, for circulating cooling air more closely adjacent to the head 230, which is aluminum die cast with cooling fins. Outer fin piece 242 is secured to fin piece 244, which is secured to the shaft, by screws (not shown). Outer fin piece 242 may be split, so that it can be removed in two halves. As such, the head can be removed without removing the shaft 214.

Each of the cylinders 202 exhaust into the exhaust chamber 248 through two holes 250 formed in the housing 206 past a flapper 252 which is secured, such as with a screw (not shown) to a post 254 of the housing 206 to normally close the holes 250. One or more outlet ports 256 are formed in the head 230 which can be connected to tubes or hoses (not shown).

Figure 19:
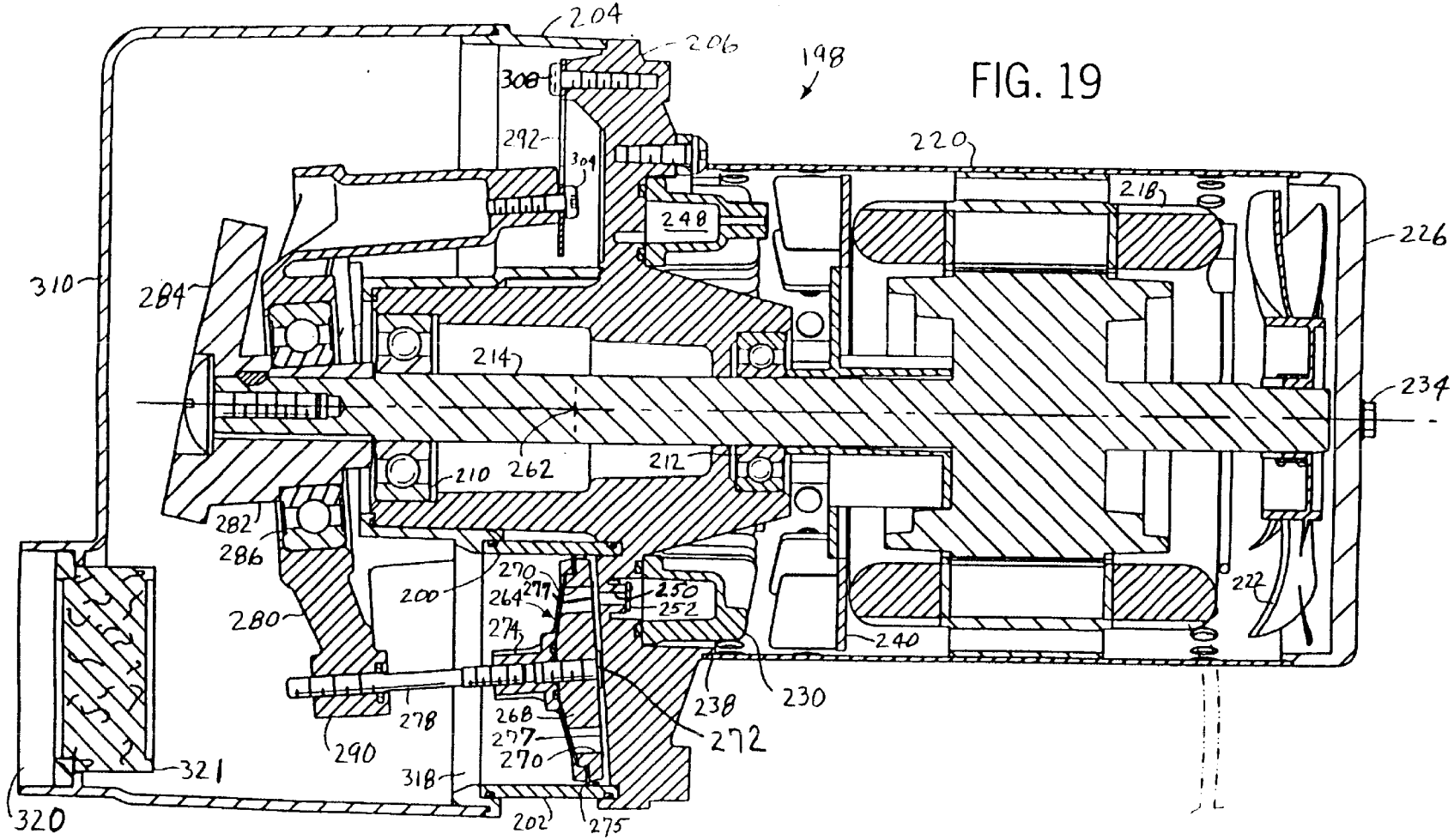
FIG. 19 is a cross-sectional view of the embodiment of FIG. 18.
Figure 20A:
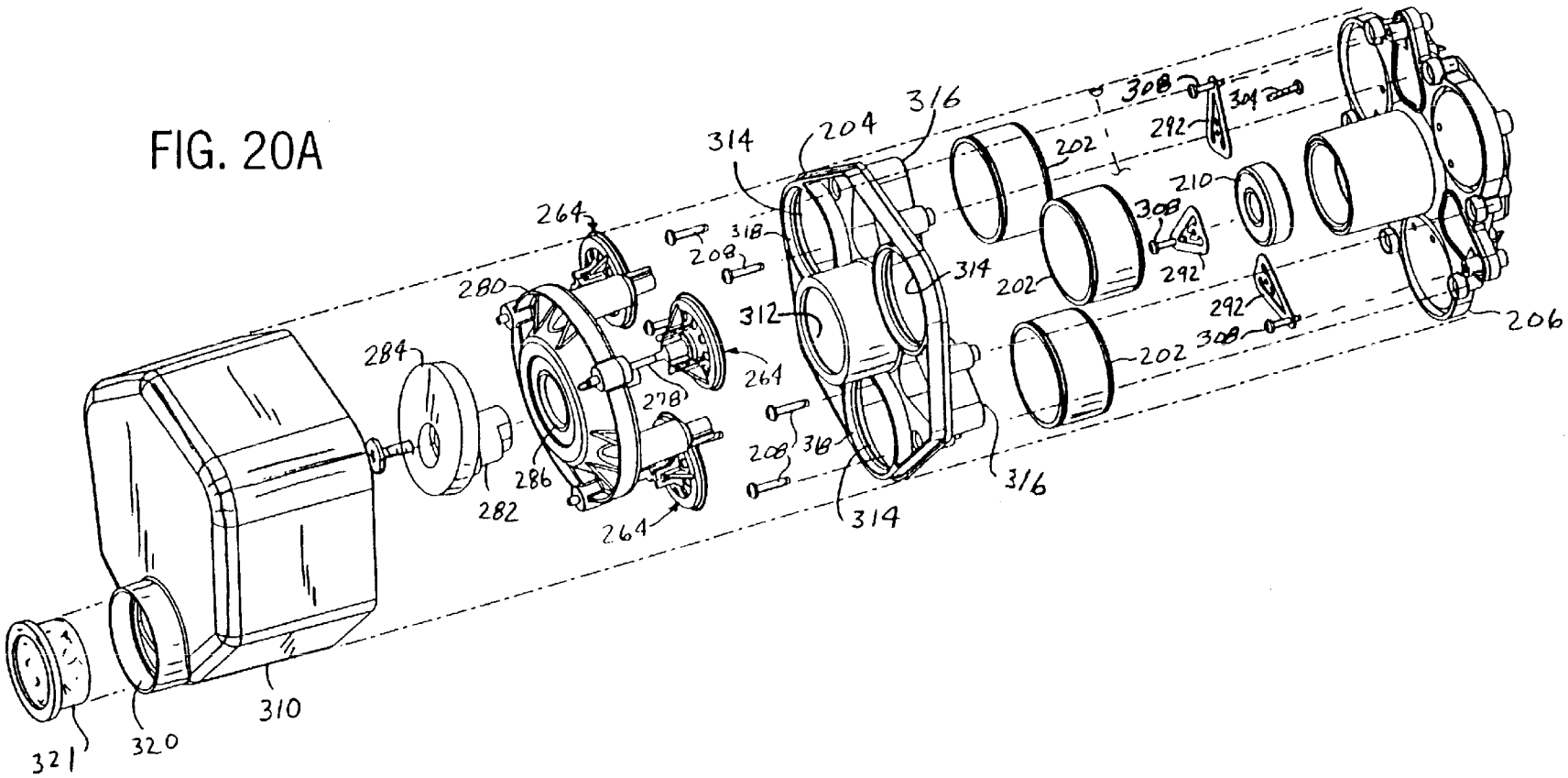
FIG. 20A is an exploded perspective view of the front portion of the embodiment of FIGS. 18 and 19 as viewed from the cylinder end of the pump.
Figure 20B:
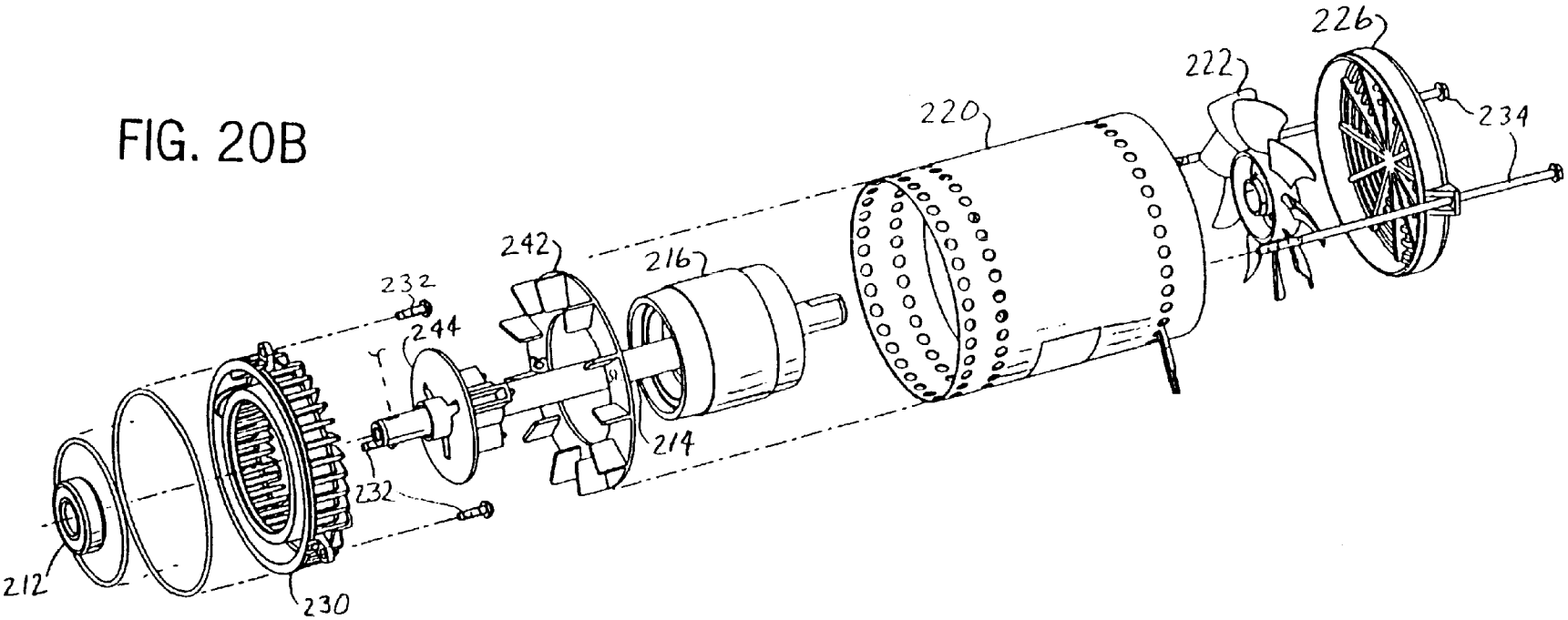
FIG. 20B is an exploded perspective view of the rear portion of the embodiment of FIGS. 18 and 19 as viewed from the cylinder end of the pump.
Figure 21A:
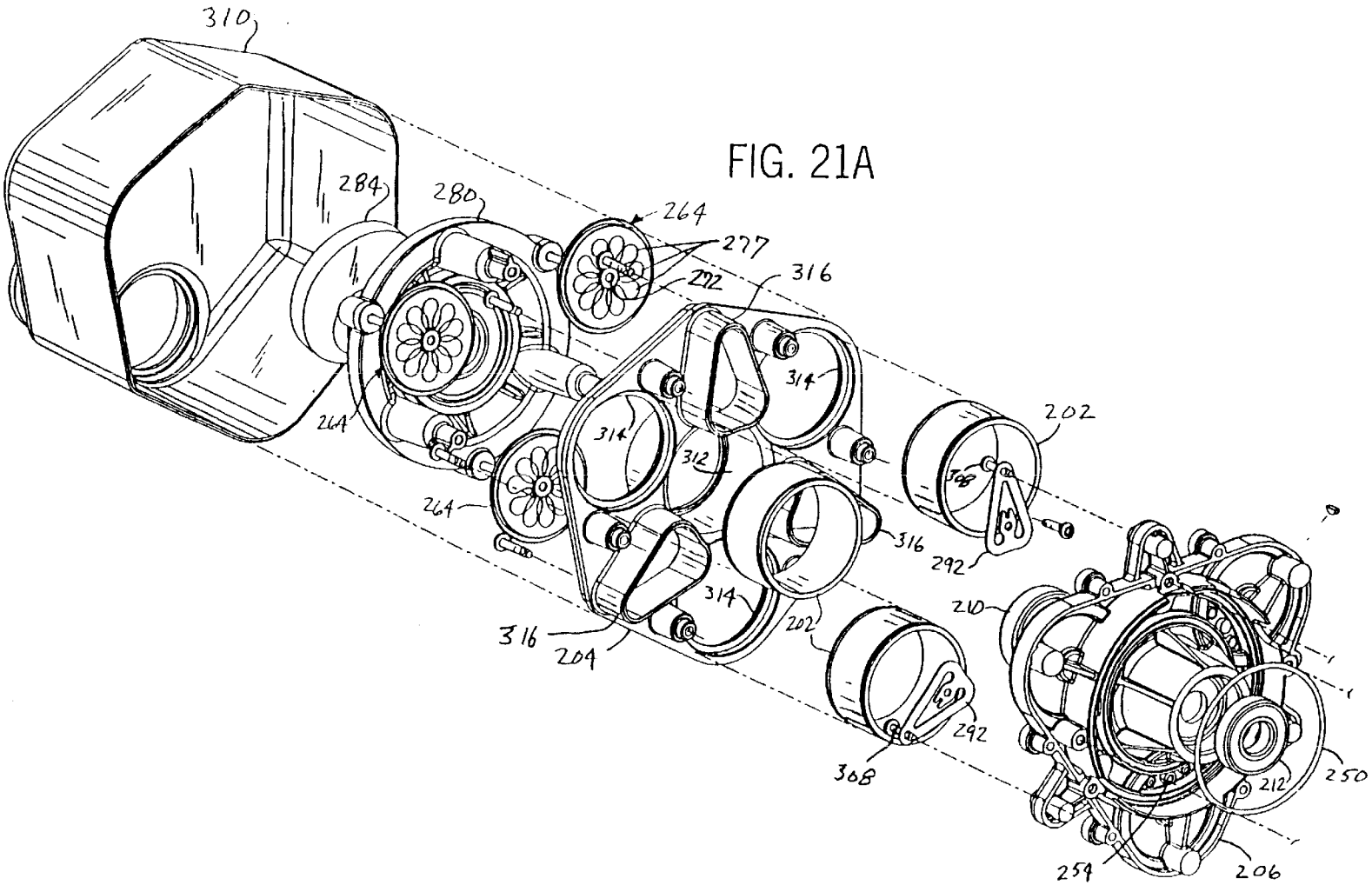
FIG. 21A is an exploded perspective view of the front portion of the embodiment of FIGS. 18 and 19 as viewed from the motor end of the pump.
Figure 21B:
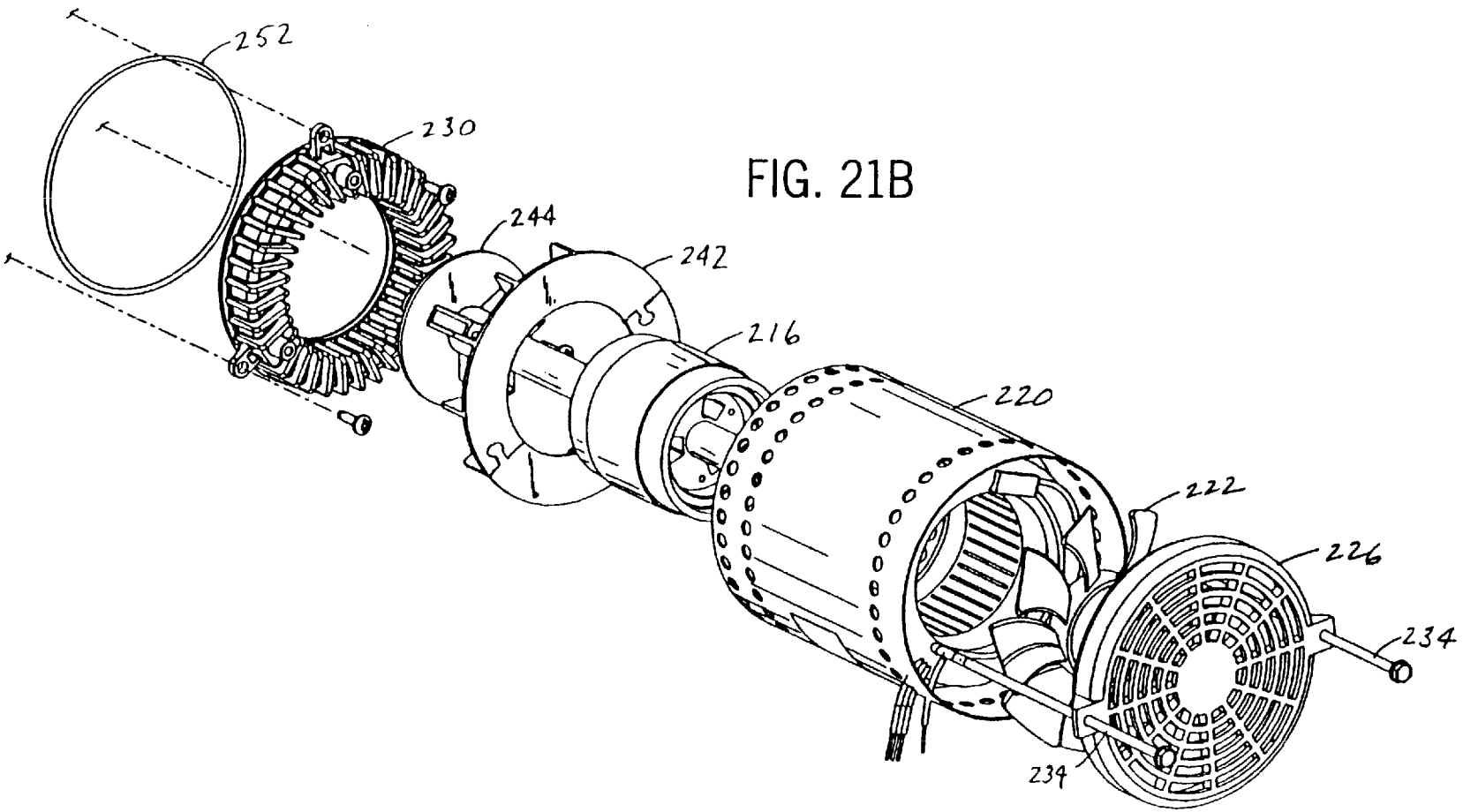
FIG. 21B is an exploded perspective view of the rear portion of the embodiment of FIGS. 18 and 19 as viewed from the motor end of the pump.

The top 260 of each cylinder 200 is inclined at an angle as shown in FIG. 19 and crowned in the direction perpendicular to the section of FIG. 19 (into the paper) so that it is defined by a portion of a conical surface which would have its apex approximately at the pivot point 262 shown in FIG. 19. Thus, the tops 260 conform to the motion of the pistons 264 as they "walk" across the tops, in close proximity thereto.

The pistons 264 each have a retainer 268 having formed therein an array of inlet holes 270. A retaining screw 272 holds the retainer 268 on a piston head 274, with a teflon cup type seal 275 sandwiched between the retainer 268 and the head 274. Retainer screw 272 also holds a radial array of inlet valve flappers 277(e.g., stainless sheet metal) over the holes 270 so as to open on the suction stroke of the piston 264 and close on the compression stroke. Thus, the inlet valves are built into the pistons in this embodiment.

A piston rod 278 has one end rigidly affixed to each piston head 274, for example by being screwed into it or otherwise rigidly attached to it, and the other end rigidly affixed to the piston carrier 280, for example by being received in a close fitting hole in it and secured with a retaining ring. Since the piston 264 actually moves in an arc as it reciprocates in the cylinder 200, the arc being generally centered at pivot point 262, the piston 264 and the cylinder 202 are positioned with respect to one another so as to somewhat compress the radially outer side (with respect to the rotational axis of the shaft 214) of the seal 275 when half way between top and bottom dead center, and to compress the radially inner side of the seal 275 when at the top and at the bottom dead center positions.

The piston rods 278 are axially stiff and radially resilient so as to permit a small amount of bending to reduce the radial forces which tend to compress the seal 275 between the retainer 268 and the cylinder 202. For example, the rods 278 are made of a relatively stiff and resilient plastic, such as acetal, and are of a diameter and length between the piston mount 290 and the piston head 274 so as to exert a minimal radial force on the seal 275 during reciprocation of the piston. The ratio of the radial stiffness of the rod divided by the axial stiffness of the rod is preferably less than 0.05, but the rod cannot be so radially resilient as to result in buckling of the rod, or in the piston head tipping so much at top dead center as to hit the housing 206. The total amount of deflection in bending of each rod 278 is plus or minus 0.005 inches (from the straight position) during reciprocation of the piston. Thus, when the piston head is centered in the cylinder, the rod 278 is bent by 0.005 inches in one direction, and when the piston head is at either the top dead center or bottom dead center position, the rod is bent by 0.005 inches in the opposite direction. At this amount of deflection, the maximum amount of side loading force placed on the seal 275 by the rod 278 is preferably less than 5 lbs., which is spread over half of the area of the seal 275, so as not to unduly stress the seal 275. At a stiffness ratio of 0.05, the maximum force on the piston would be 100 pounds (5 lbs. maximum radial force divided by the stiffness ratio of 0.05). Disregarding inertia and friction forces on the piston head and rod, at 15 psi maximum pressure, the piston diameter would have to be less than about 2.9 inches.

It is also noted that the resilience of the rods 278 not only reduces side loading of the seals 275, so as to prolong their life, but also facilitates making the center to center tolerances of the cylinders 202 and of the pistons 264 reasonably large while still permitting assembly and operation of the pump.

The motor shaft 214 projects through a central opening in the piston carrier 280 and a hub 282 having a counterweight 284 is mounted on the end of the projecting end of the shaft 214, and is keyed to the shaft 214. The hub 282 is an eccentric with its centerline at an acute angle to the axis of the shaft 214. The piston carrier 280 is supported by a bearing 286 on the outside of the hub 282. The piston carrier 280 has three equiangularly spaced piston mounts 290, which as stated above have holes which mount the piston rods 278.

Figure 22:
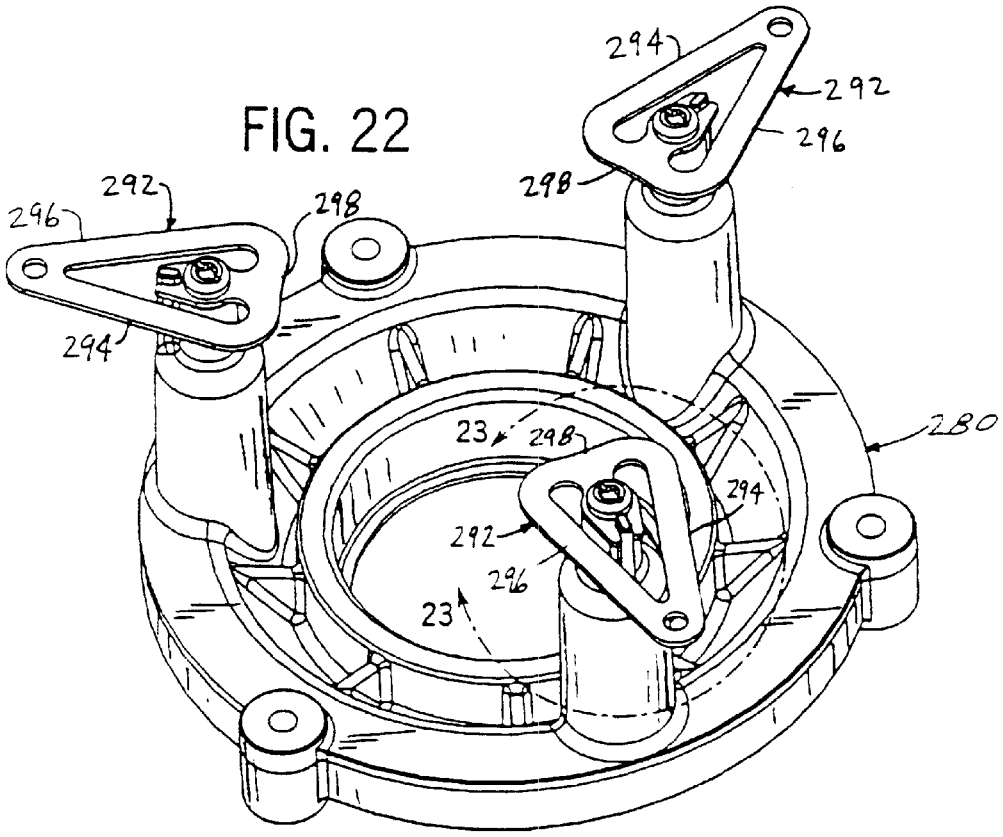
FIG. 22 is a detail perspective view of the piston carrier/leaf spring assembly for the embodiment of FIGS. 18–21.
Figure 23:
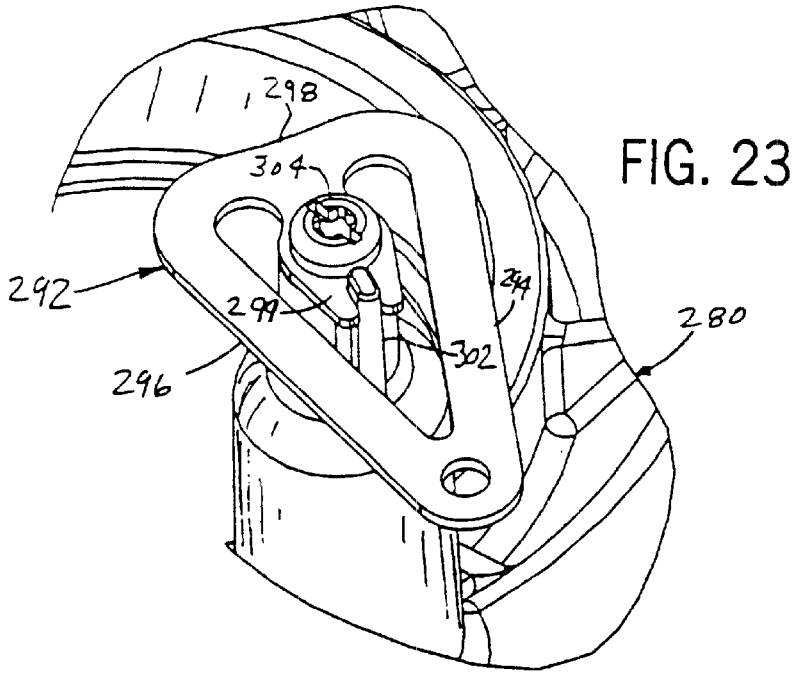
FIG. 23 is a detail perspective view of a portion of FIG. 22.
Figure 24:
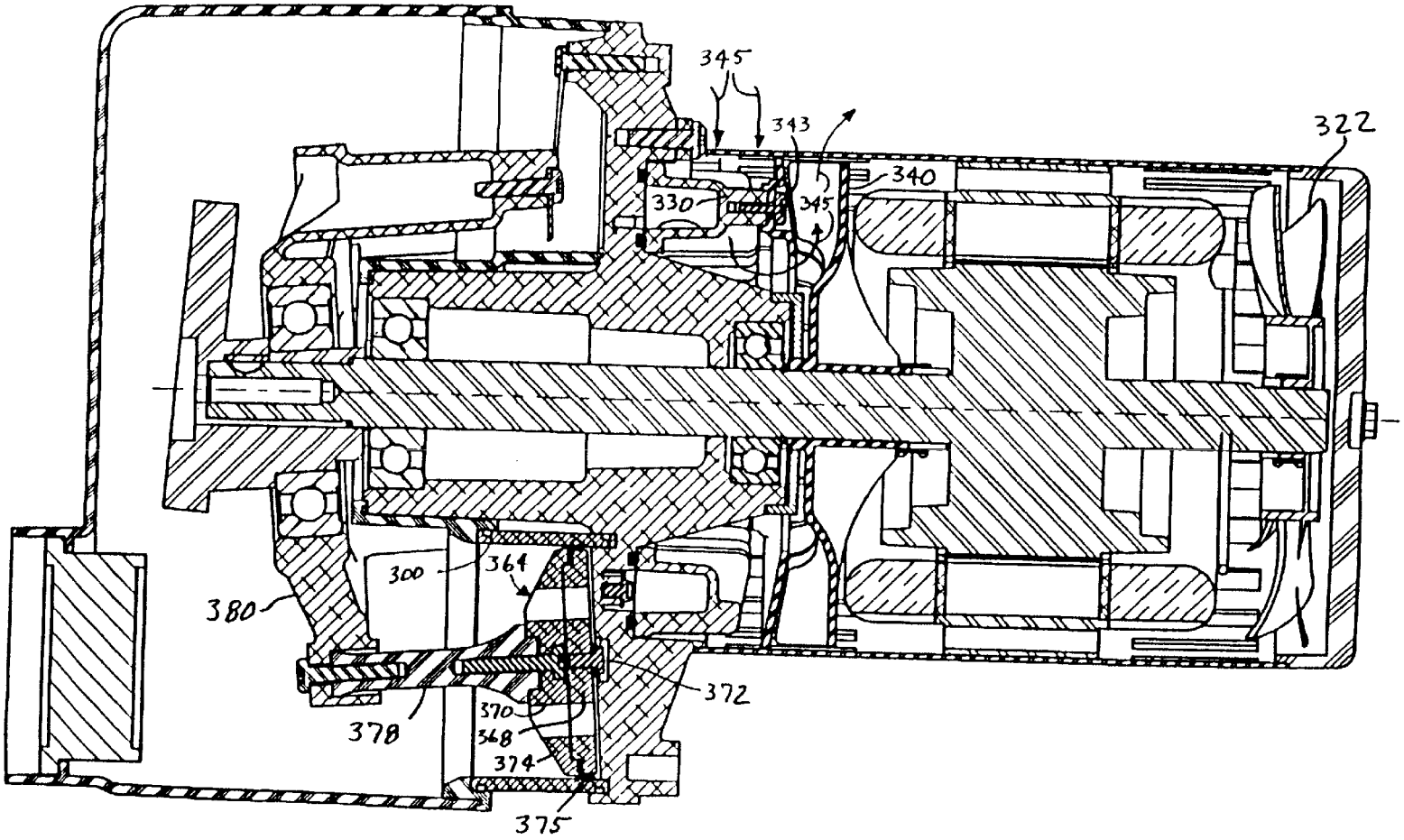
FIG. 24 is a view similar to FIG. 19 of a modified embodiment.

The piston carrier 280 is also supported by three leaf springs 292, more particularly shown in FIGS. 22 and 23. Each leaf spring 292 is generally A-shaped, having three legs 294, 296, 298 forming a triangle, with legs 294 and 296 equal and leg 298 shorter, forming a base, and a mounting flange 299 extending into the triangle from the base leg 298. The leaf springs 292 may, for example, be made of thin (e.g., #18 gage-0.0478") spring steel. The flange 299 is forked at its end so as to receive a rib 302 which extends up from the piston carrier mounting surface, so as to prevent relative rotation between the leaf springs 292 and the piston carrier 280. A hole is formed in the flange 299 for mounting the piston carrier with a screw 304 and a hole is formed in the coiner of the spring 292 where the legs 294, 296 join, for mounting to the housing 206 with a screw 308. The leaf springs 292 support the piston carrier/piston assembly, at least in part, and therefore relieve some of the bearing loads.

The retainer 204 in combination with cover 310, both of which may be molded plastic, enclose much of the working mechanism, including the leaf springs 292, the ends of the cylinders 202 opposite from the compression chambers, the backsides of the pistons, the piston rods and piston carrier and the hub 282 and bearing 286, without enclosing the cylinders 202, so as to permit air circulation around the outside of the cylinders 202 for cooling. As such, the retainer 204 has a central opening 312 in which is received a forwardly extending annular portion of the housing 206, three openings 314, each of which receives the open end of one of the cylinders 202, and three generally triangular structures 316 which abut against the housing 206 to surround the leaf springs 292. A tapered lead-in surface 318 (FIG. 19) of each opening 314 eases insertion of the seal 275 into the cylinders 202. The cover 310 receives a flange of the retainer 204 and may be retained by a snap or friction fit, or other suitable means, and includes intake hole 320 which mounts a filter 321 to filter intake air.

Thus, the housing 206, retainer 204 and cover 310 enclose the crankcase 324 (FIG. 19) to help reduce noise and keep the crankcase cleaner, while exposing the outer surfaces of the cylinders 202 to outside cooling air. Since there are three pistons all operating out of phase with each other, there will be little or no variance of the volume of the crankcase, which also helps reduce noise.

The embodiment 398 of FIGS. 24–26B is substantially the same as the embodiment 298 except as described below. In general, elements of the pump 398 corresponding to the elements of the pump 298 are identified with the same reference number plus 100.

One difference is in the piston rod 378, which is a separate piece that is rigidly secured to the piston carrier 380 and to the piston 364 with a screw at each end. The ends of the piston rod 378 are rigidly secured to the respective piston carrier 380 or piston 264, but the rod 378 itself is radially resilient but longitudinally inextensible and incompressible. Thereby, the rod is not compressed or stretched significantly in length as pumping occurs, but the rod can resiliently bend to permit the piston 364 to reciprocate in the straight walled cylinder bore 300. The rod 378 should bend resiliently quite easily, so as not to place undue loads on the seal 375 which slides between the piston 264 and the bore 300 as explained above respecting the rods 278. For example, the rods 378 can be made of acetal plastic, and be of a length and diameter so as to apply a maximum side loading force of 5 lbs. or less on the seals 375, as explained above with respect to the rods 278.

Figure 25A:
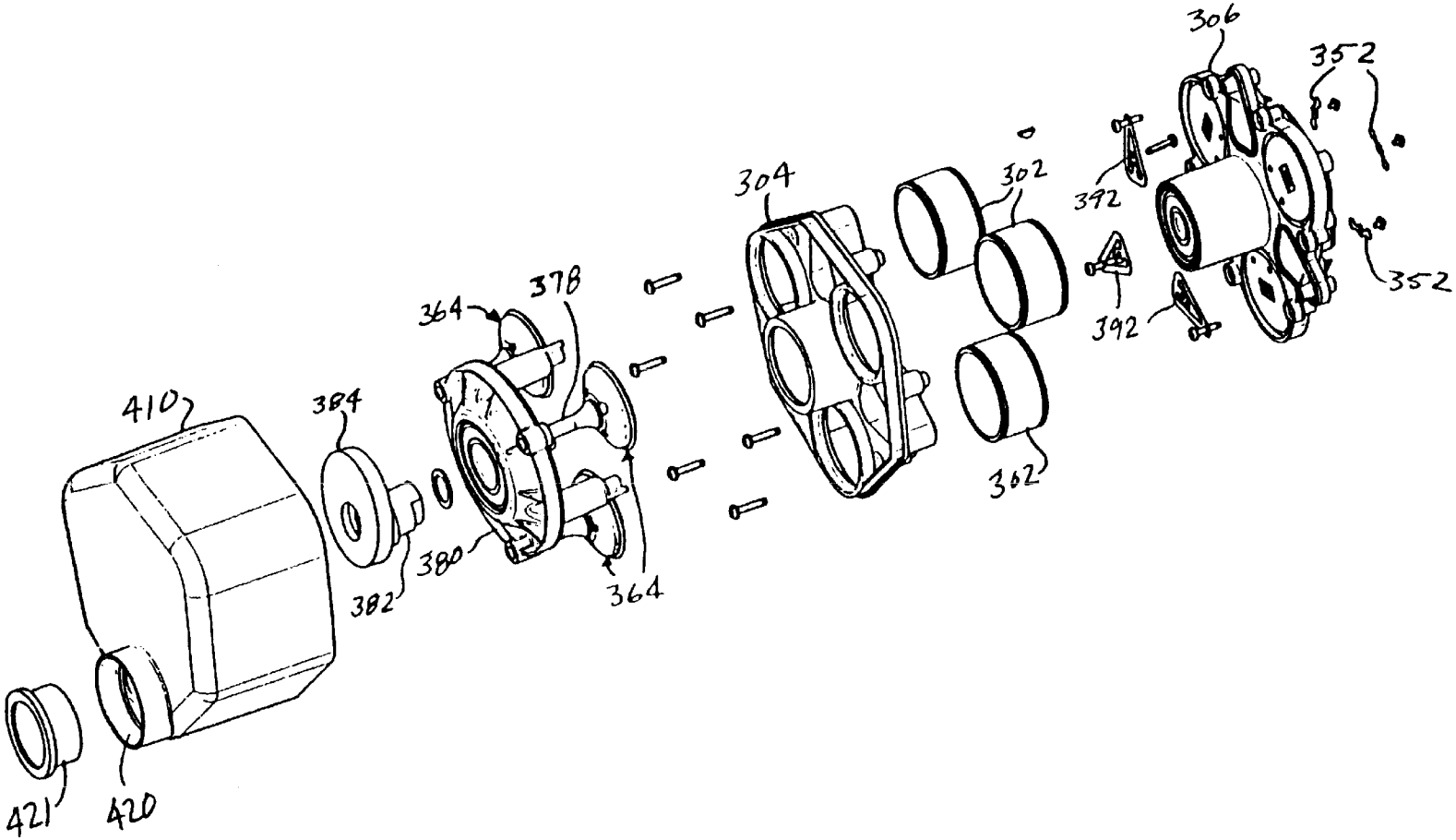
FIG. 25A is a view similar to FIG. 20A but of the embodiment of FIG. 24.
Figure 25B:
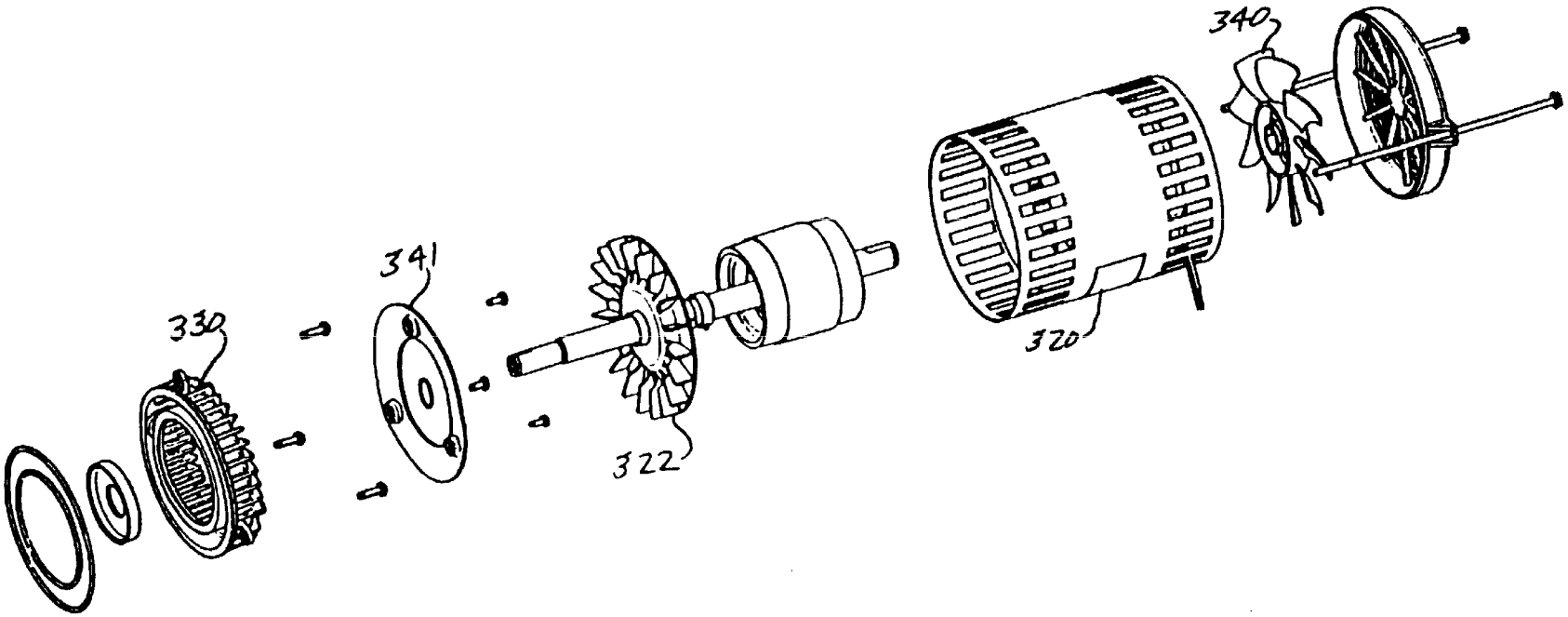
FIG. 25B is a view similar to FIG. 20B but of the embodiment of FIG. 24.
Figure 26A:
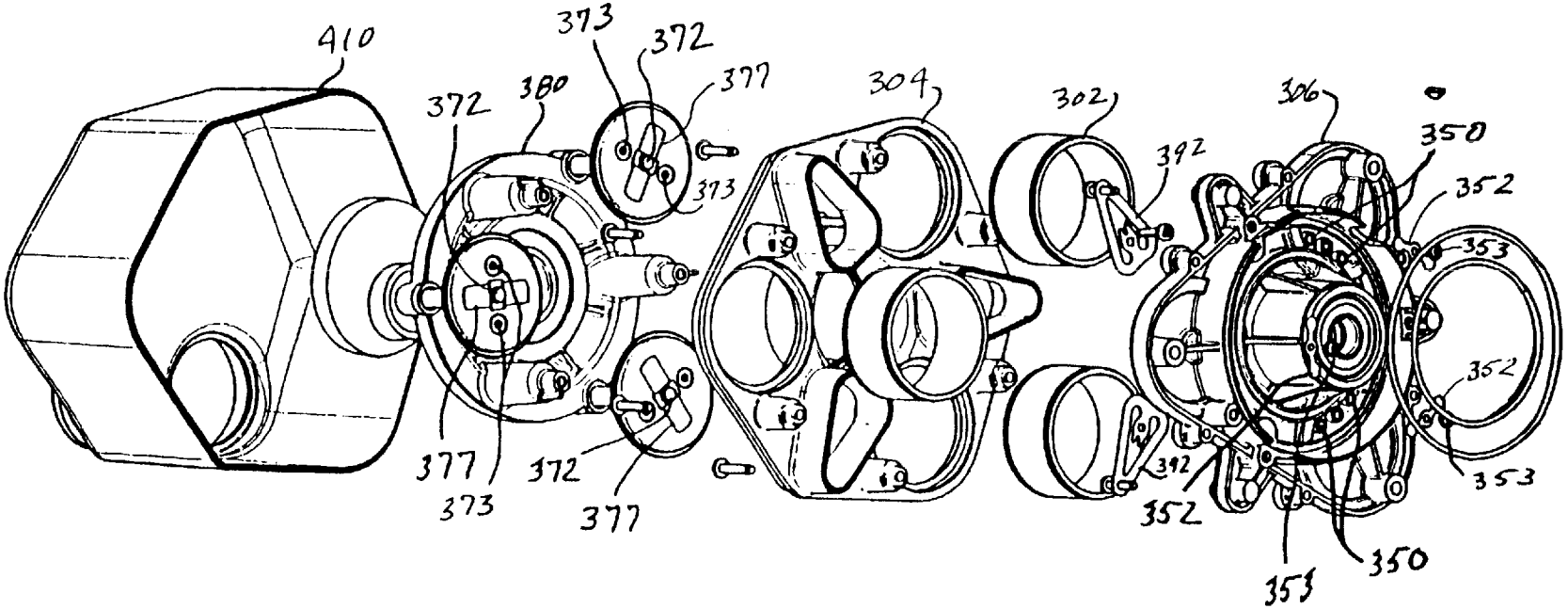
FIG. 26A is a view similar to FIG. 21A but of the embodiment of FIG. 24.
Figure 26B:
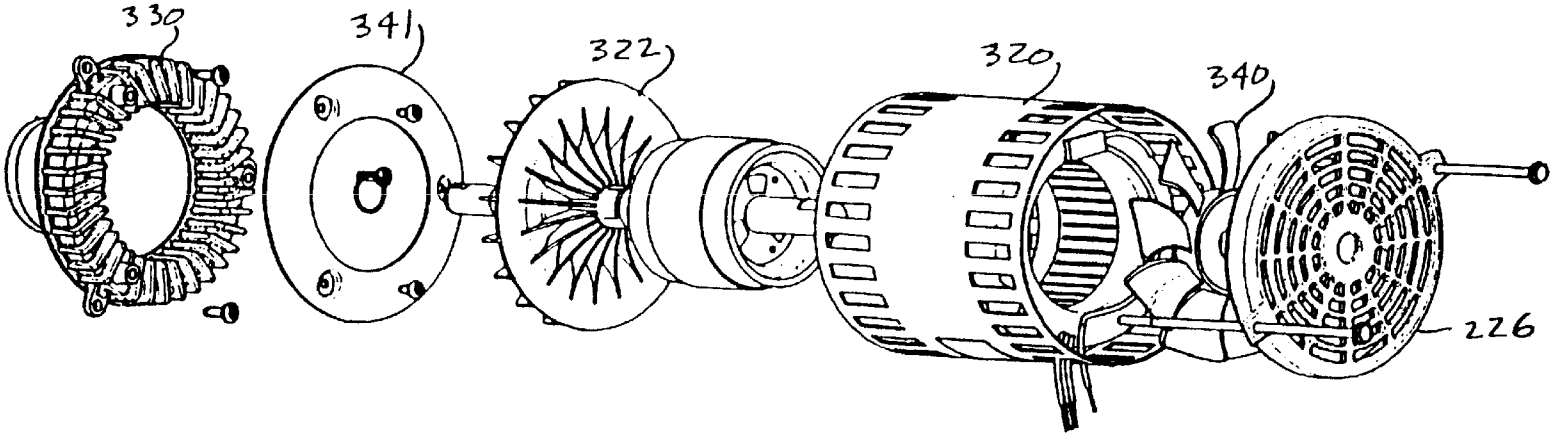
FIG. 26B is a view similar to FIG. 21B but of the embodiment of FIG. 24.

The piston 364 also differs somewhat in its construction, having a retainer 368 held onto the piston head 374 by two screws 373 (FIG. 20A) and an inlet flapper 377 covering two oppositely disposed inlet holes 370. The flapper 377 is secured with screw 372. In addition, FIGS. 25A and 26A illustrate the outlet flappers 352 exploded away from the housing 306, which normally cover holes 350 and are secured to the housing 306 with screw 353.

Another difference is that the fan 340 is made in one piece, preferably of plastic, as is the fan 322 also made in one piece. The fans 340 and 322 can be secured to the shaft 315 by spring clips or other suitable means.

In addition, an annular air deflector 341 is secured to the head 330 by screws 343. The air deflector 341 causes air drawn into the motor shell 320 (through holes therein) to be drawn past the fins of the head 330 and then exhausted from the motor shell through holes therein on the other side of the deflector 341. The air flow path is shown by arrows 345 in FIG. 24.

Preferred embodiments of the invention have been described in considerable detail. Many modifications and variations will be apparent to those skilled in the art. Therefore, the invention should not be limited to the embodiments described, but should be defined by the claims which follow.

We claim:

1. An axial piston fluid pumping apparatus, comprising:

a drive shaft;

a cylinder having a bore;

a fluid inlet and a fluid outlet communicating with each cylinder bore;

a bearing mounted on the shaft with the centerline of the bearing at an angle to the shaft axis;

a piston carrier mounted on the bearing; and a wobble piston mounted to the piston carrier for reciprocation in the bore when the shaft is turned; and a leaf spring supporting said piston in said cylinder.

2. A fluid pumping apparatus as claimed in claim 1, wherein the bearing is mounted on a hub that is mounted on the shaft with the axis of the hub at an acute angle to the shaft axis so that the hub axis precesses about the shaft axis as the shaft is rotated.

3. A fluid pumping apparatus as claimed in with claim 1, wherein the cylinder bore is parallel to the axis of the shaft.

4. A fluid pumping apparatus as claimed in claim 1, wherein three of said leaf springs support said piston.

5. A fluid pumping apparatus as claimed in claim 1, wherein said leaf spring is connected between said piston carrier and a housing.

6. A fluid pumping apparatus as claimed in claim 5, wherein said housing supports said cylinder.

7. A fluid pumping apparatus as claimed in claim 6, wherein said housing supports said shaft.

8. A fluid pumping apparatus as claimed in claim 5, wherein said piston carrier and leaf spring are enclosed and an outer surface of said cylinder is exposed.

9. A fluid pumping apparatus as claimed in claim 1, wherein said piston includes an axially stiff and radially resilient connecting rod which is connected to said piston carrier.

10. A fluid pumping apparatus as claimed in claim 9, wherein said connecting rod is rigidly connected to said piston carrier.

11. A fluid pumping apparatus as claimed in claim 10, wherein said connecting rod is rigidly attached to a head of said piston.

12. A fluid pumping apparatus as claimed in claim 1, wherein a surface inside said cylinder which faces said piston has the shape of a section of a cone.

13. A fluid pumping apparatus as claimed in claim 1, further comprising a cylinder retainer and a housing, said cylinder being positioned between said cylinder retainer and said housing.

14. A fluid pumping apparatus as claimed in claim 13, wherein said cylinder retainer has a tapered lead-in surface leading into said cylinder.

15. A fluid pumping apparatus as claimed in claim 1, wherein said fluid inlet is provided in said piston.

16. A fluid pumping apparatus as claimed in claim 15, further comprising a housing, and wherein said fluid outlet is provided in said housing.

17. A fluid pumping apparatus as claimed in claim 1, wherein said leaf spring is mounted so as not to rotate in a plane perpendicular to a longitudinal axis of said shaft.

18. A fluid pumping apparatus, as claimed in claim 1, having multiple cylinders and a corresponding number of pistons.

19. A fluid pumping apparatus as claimed in claim 17, having multiple leaf springs supporting said pistons.

20. A fluid pumping apparatus as claimed in claim 19, wherein said leaf springs and piston carrier are enclosed.

21. An axial piston fluid pumping apparatus, comprising:

a drive shaft;

a cylinder having a bore;

a fluid inlet and a fluid outlet communicating with each cylinder bore;

a bearing mounted on the shaft with the centerline of the bearing at an angle to the shaft axis;

a piston carrier mounted on the bearing; and a wobble piston including a radially resilient connecting rod mounting said wobble piston to said piston carrier for reciprocation of said piston in the bore when the shaft is turned.

22. A fluid pumping apparatus as claimed in claim 21, wherein said connecting rod is rigidly affixed to said piston carrier.

23. A fluid pumping apparatus as claimed in claim 21, wherein said connecting rod is rigidly affixed to a head of said piston.

24. A fluid pumping apparatus as claimed in claim 21, wherein said connecting rod is rigidly affixed to said piston and to said piston carrier, and wherein the ratio of the maximum radial force exerted by said rod on said piston divided by the maximum axial force exerted by said rod on said piston is less than or equal to 0.05.

25. A fluid pumping apparatus, comprising:

a drive shaft;

a housing;

a plurality of tubular cylinders having bores disposed symmetrically about the axis of the shaft, one end of each cylinder facing said housing and the other end being open;

fluid inlet and outlet valves communicating with each cylinder bore;

a piston carrier rotatably mounted on a bearing at an acute angle to the shaft axis so that the piston carrier precesses about the shaft axis as the shaft is rotated; and a plurality of wobble pistons, one for each said cylinder, each said piston being attached to said piston carrier and disposed in and sealed with a respective cylinder bore so as to reciprocate in said cylinder bore as said piston carrier precesses; and an enclosure enclosing said piston carrier and the open ends of said cylinders and not enclosing outer surfaces of said cylinders.

26. A fluid pumping apparatus, comprising;

a drive shaft;

a housing;

a plurality of cylinders having bores disposed symmetrically about the axis of the shaft, open ends and outer surfaces;

fluid inlet and outlet valves communicating with each cylinder bore;

a piston carrier rotatably mounted on a bearing at an acute angle to the shaft axis so that the piston carrier precesses about the shaft axis as the shaft is rotated; and a plurality of wobble pistons, one for each said cylinder, each said piston being attached to said piston carrier and disposed in and seated with a respective cylinder bore so as to reciprocate in said cylinder bore as said piston carrier precesses; and a plurality of leaf springs supporting said piston carrier.

27. A fluid pumping apparatus as claimed in claim 26, further comprising an enclosure enclosing said piston carrier, said open ends of said cylinders and said leaf springs, and not enclosing said outer surfaces of said cylinders.

28. A fluid pumping apparatus as claimed in claim 27, further comprising a housing against an end of said cylinders opposite from said open end, wherein said housing supports said cylinders, said shaft and said enclosure.

* * * * *

UNITED STATES PATENT AND TRADEMARK OFFICE

CERTIFICATE OF CORRECTION

PATENT NO. : 6,450,777 B2
DATED : September 17, 2002
INVENTOR(S) : William H. Lynn et al.

It is certified that error appears in the above-identified patent and that said Letters Patent is hereby corrected as shown below:

Column 2,
Line 21, “cylinder,” should be -- cylinders --.

Column 4,
Line 17, “Value” should be -- value --.

Column 5,
Line 5, “vibration,” should be -- vibration. --.

Column 6,
Line 7, “cylinder 1” should be -- cylinder I --.
Line 18, “fart” should be -- far --.
Line 39, “Shaft” should be -- shaft --.
Line 49, “Fig. 1” should be -- Fig. 11 --.

Column 8,
Line 16, “bead” should be -- head --.
Line 47, “journal led” should be -- journalled --.

Column 10,
Line 28, “coiner” should be -- corner --.

Column 14,
Line 6, “seated” should be -- sealed --.

Signed and Sealed this

Fourth Day of March, 2003

JAMES E. ROGAN
*Director of the United States Patent and Trademark Office*